US011673631B2

(12) United States Patent
Tohill

(10) Patent No.: US 11,673,631 B2
(45) Date of Patent: Jun. 13, 2023

(54) WATERCRAFT EQUIPMENT COUPLING DEVICE AND METHOD OF USE

(71) Applicant: Thomas Tohill, Benton, TN (US)

(72) Inventor: Thomas Tohill, Benton, TN (US)

( * ) Notice: Subject to any disclaimer, the term of this patent is extended or adjusted under 35 U.S.C. 154(b) by 210 days.

(21) Appl. No.: 17/104,812

(22) Filed: Nov. 25, 2020

(65) Prior Publication Data

US 2022/0161900 A1 May 26, 2022

(51) Int. Cl.
*B63B 34/26* (2020.01)
*B63B 34/21* (2020.01)
*B63H 16/04* (2006.01)

(52) U.S. Cl.
CPC ..... *B63B 34/26* (2020.02); *B63B 34/21* (2020.02); *B63H 16/04* (2013.01)

(58) Field of Classification Search
CPC ..... B63B 34/26; B63B 34/21; B63H 16/04
See application file for complete search history.

(56) References Cited

U.S. PATENT DOCUMENTS 5,816,873 A * 10/1998 Pestel ..... B63H 16/06 114/345
6,755,145 B2 * 6/2004 Bolebruch ..... B63B 34/26 114/347
7,004,100 B1 * 2/2006 Rard ..... B63B 34/26 114/364
7,527,012 B2 * 5/2009 Kutny Splaine ..... B63B 25/002 24/339
8,915,207 B2 * 12/2014 Wirsig ..... B63B 39/00 114/364
2012/0216738 A1 * 8/2012 Altfather ..... F04B 9/14 114/343
2019/0106190 A1 * 4/2019 Schibli ..... B63H 20/007

FOREIGN PATENT DOCUMENTS

WO WO-2017203189 A1 * 11/2017 ..... A63B 35/06

* cited by examiner

*Primary Examiner* — S. Joseph Morano
*Assistant Examiner* — Jovon E Hayes
(74) *Attorney, Agent, or Firm* — Patrick Reilly

(57) ABSTRACT

A device and method for temporarily attach a tool, such as a paddle or a fluid container, to a floatation watercraft, wherein the device is partially covered by a user's gear, such as a kayak skirt. The user's gear preferably includes an elastic edge element that slips under a lip of a cockpit or hatch of the watercraft wherein the invented is positioned between the lip and the elastic edge element while coupled with one or more tools. The device extends beyond both the watercraft lip and the user's gear whereby the tool may be supported distally from the watercraft lip.

22 Claims, 27 Drawing Sheets

WATERCRAFT EQUIPMENT COUPLING DEVICE AND METHOD OF USE

FIELD OF THE INVENTION

The present invention relates to an article of manufacture or a device to attach to the lip of a kayak, canoe or other human powered watercraft that provides easy access to a tool such as a paddle clip. In particular, it relates to a device that attaches to the lip of the cockpit of the watercraft, allows for use of a spray skirt or kayak skirt without tangling or getting trapped underneath the skirt, and provides a tool end such as a paddle clip that stands clear of the edge of the skirt.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Anyone who has been kayaking before will surely remember the elastic 'skirt' component that goes around one's waist and stops water from splashing onto one's lap and into the boat, and the difficulties that sometimes arise in using one. Particularly, it's well known in the art to provide a 'paddle clip' that hooks onto the cockpit of a kayak or canoe and provides a holder in which to place one's paddle, but what if the skirt also is secured around the edge of the cockpit, as most kayak skirts are? The paddle clip may end up not being used, with the skirt having to be stretched over top of the clip, or the user may manage to figure out some sort of ad-hoc 'compromise' that allows the two devices to share space and still be mostly effective.

However, the prior art so far has failed to provide an optimal solution for a tool clip such as a paddle clip to hook onto the cockpit of a kayak and deliberately provide for the presence of a kayak skirt, such that both the clip and the skirt are fully effective. There is therefore a long-felt need for a device that clips into a watercraft cockpit, is shaped to accommodate a kayak skirt, and provides a tool end that stands clear of the skirt's edge.

SUMMARY OF THE INVENTION

Towards these and other objects of the method of the present invention (hereinafter, "the invented method") that are made obvious to one of ordinary skill in the art in light of the present disclosure, the invented method provides a device (hereinafter, "the invented device") that removably attaches to an accessible point on a watercraft such as a kayak, canoe, or boat; provides a tool attachment for keeping an object such as a paddle or even a beverage can holder in easy reach; and is shaped to facilitate use of a textile component such as a kayak skirt, spray skirt, cockpit cover, or similar.

In a preferred embodiment, the attachment end of the device is C-shaped to fasten around the lip of a cockpit of a kayak and the body of the device is shaped to have the kayak skirt secured around the body of the device, such that the tool end stands clear of the kayak skirt rather than being tangled up with or trapped underneath the skirt hem, which is a commonly known limitation of the prior art.

In other alternate preferred embodiments, the lip of the watercraft may not optimally fit into a C-shaped fastener, as different brands build differently-shaped boats, and in different respective embodiments the attachment end of the device is shaped differently to fit those different boats. In still further possible embodiments, the attachment end might attach to some other useful point on a boat besides the lip, should one be available and preferred. It should be noted also that, while many preferred embodiments are directed toward providing reachable access to a tool end item by a user sitting in the cockpit of the watercraft, the invented device need not be placed within reach, as some possible applications, such as mounting a flag or sign on one's watercraft, don't necessitate this. Additionally, more than one instance of the invented device could be attached to the same boat if there's space and the user would like to do this.

The shape of the tool end might vary widely depending on what tool is being attached. In one preferred embodiment, a C-shaped tool end may function as a 'paddle clip' in which to store a paddle or an oar, or might fit around something shaped similarly, such as a small flashlight, the handle of a bag, the handle of an umbrella, and so on. Another preferred tool end shape is a clamp or clasp, such that something thin can be secured between the clamp sides such as some papers, the top of a waterproof bag, or the brim of a hat. Another preferred tool end shape is, or is adapted to fit around, a cylindrical container such as a cup shape, so the tool end might function as a drink holder or a cup in which to place small objects such as perhaps sunglasses, a compass, loose change, or a snack. The tool end itself may also be shaped to be a tool, rather than offer a spot for one: there might be a tool end that's a bottle opener, or a compass, or a multitool, or a ring to tie something onto. Additionally, the tool end might be a standard generic shape to allow compatibility with further attachments unrelated to the invented device; for instance, a tool end with a hexagonal profile might be attachable to any number of useful unrelated tools that may happen to use that attachment point standard. Use of two or more instances of the invented device also hold possibilities, such as attaching a sunshade or rain cover over the cockpit of one's kayak using one device on each side, or mounting a sign on the side of one's canoe.

In one embodiment of the invention, the invented device is a single, shaped piece, with one particular shape of attachment end and one particular shape of tool end. In this case, a store selling the invented device might offer a variety of embodiments of the invented device, with different attachment end shapes to allow for customers equipping various different models of watercraft, and a variety of tool end shapes for each attachment end shape to allow the same customer to collect multiple options of tool to attach to the same model of boat. In another preferred embodiment, the device consists of two detachably coupled pieces, such that one of the ends can be 'swapped out' for a different shape, such as uncoupling one tool end option and replacing with another. In another preferred embodiment, a single device with a detachable attachment end and/or tool end is offered, such that the single device can be customized according to boat compatibility and user preference of tool. The ends might be made attachable/detachable by any suitable means known in the art, such as a body piece of the invented device with threaded ends, such that detachable attachment and tool ends may be screwed onto the device, or the ends may also be shaped to allow one to 'pop' custom attachments on and off; these are just two non-limiting examples.

Additionally, the body of the device may be shaped differently in different embodiments for optimal compatibility with various different kayak skirts or watercraft, and may be any shape suitable for performing the disclosed function.

It should be noted that, though this disclosure is directed mostly toward implementation on boats such as kayaks, the invented device might be suitable for other watercraft not yet mentioned, such as a jet ski maybe, and could easily be suitable for many non-watergoing applications also, such as a need for a mounted tool holder or attachment for a car or plane.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF DRAWINGS

The detailed description of some embodiments of the invention is made below with reference to the accompanying figures, wherein like numerals represent corresponding parts of the figures.

DETAILED DESCRIPTION OF DRAWINGS

In the following detailed description of the invention, numerous details, examples, and embodiments of the invention are described. However, it will be clear and apparent to one skilled in the art that the invention is not limited to the embodiments set forth and that the invention can be adapted for any of several applications.

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims. Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Additionally, it should be noted herein that the invented device is scalable and might be any suitable size for attachment as herein described. Some exemplary measurements are offered herein, but these should not be construed as limiting or exclusive.

Figure 1:
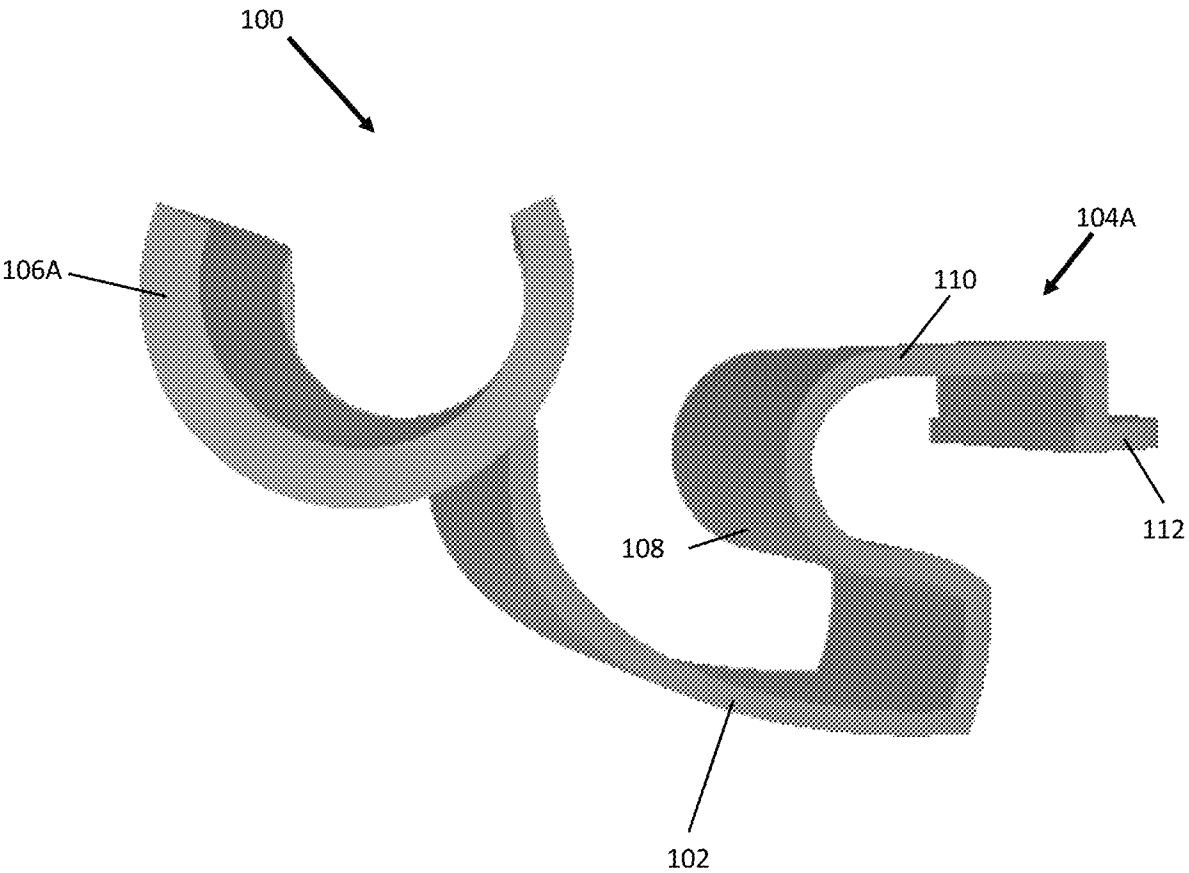
FIG. 1 is a 3D model of one preferred embodiment of an invented first device.

Referring now generally to the Figures and particularly to FIG. 1, FIG. 1 is a profile view of an invented first device 100 with a body length 102, a first attachment end 104A, and a paddle holder fixed tool end 106A. Throughout, this description, several variations on the shape of a fixed tool end 106, numbered 106A-Z, and variations on the shape of an attachment end 104, numbered 104A-Z, will be discussed; the paddle holder fixed tool end 106A and the first attachment end 104A are the first in these respective series. All fixed tool end variations 106A-Z should be considered subcategories and instances of the fixed tool end 106, and all attachment end variations 104A-Z should be considered subcategories and instances of the attachment end 104. The attachment end 104 comprises a curve 108, a top 110, and a latch 112. In this first embodiment, the first device 100 consists of a single shaped piece of material or is otherwise unitary and/or not meant to be dismantled.

The material of which the first device 100 is composed may be or include extruded, 3D-printed, injection-molded, or otherwise molded plastic, metal, rubber, wood, or any other suitable material known in the art and by any suitable fabrication equipment known in the art. In early production and testing of the invention, a Prusa FDM™ 3D printer as marketed by Prusa Research. of the Prague, Czech Republic with a Polylactic acid or polylactide ("PLA") filament has been successfully used to make sample embodiments of the invention out of plastic; feedback from testing and use, or presence of sufficiently high commercial demand once the invention is available in the market, might naturally prompt changes in material choice or means of manufacture. Additionally, it should be understood that one or more portions could be made of different materials, as appropriate, and still be an embodiment of the invention; as one non-limiting example, the attachment end 104 might be made of more 'bendable' material than the body 102 of the device, such as softer plastic or rubber, so the device can be attached by bending the softer material to fit around the lip of the craft.

Figure 2A:
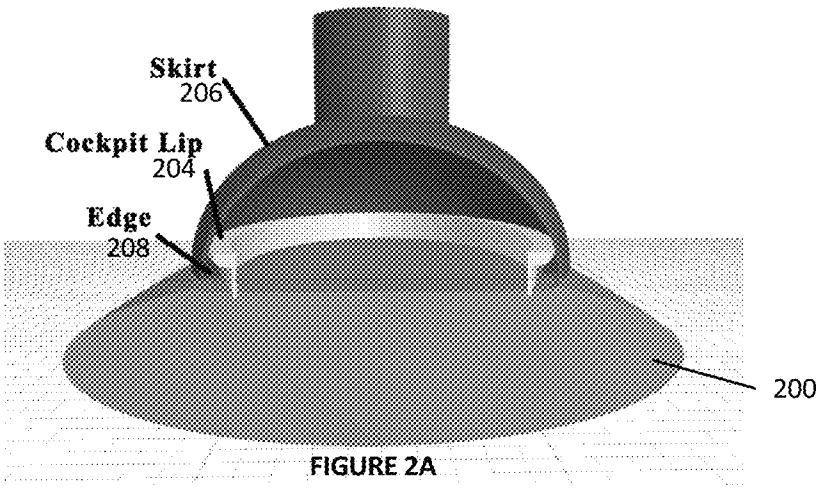
FIG. 2A is a 3D model of a prior art kayak and spray skirt.
Figure 2B:
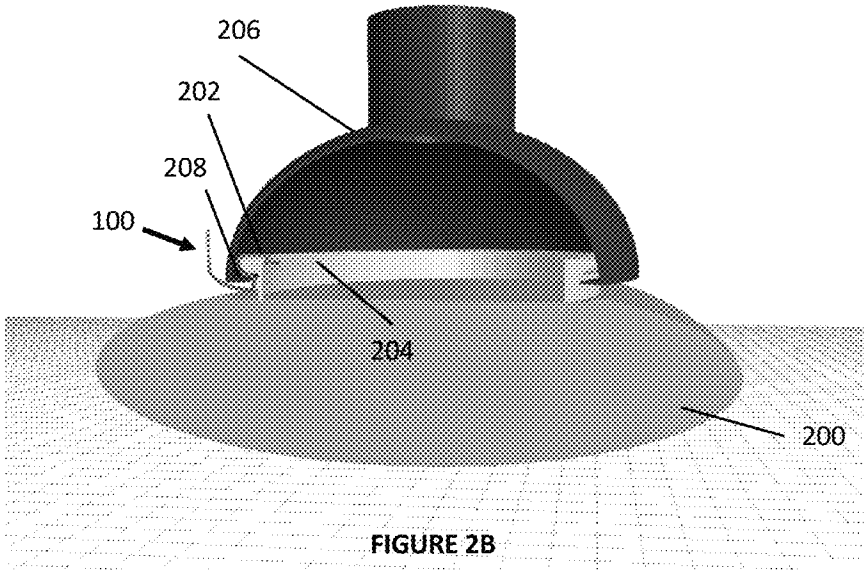
FIG. 2B is the same 3D model of the prior art kayak and spray skirt of FIG. 2A, but now equipped with the invented device of FIG. 1.

Referring now generally to the Figures and particularly to FIGS. 2A and 2B, FIGS. 2A and 2B present a standard prior art kayak 200, with and without the first device 100 attached at an attachment point 202 representing a chosen point around a cockpit lip 204. FIG. 2A presents only the prior art kayak 200 with its usual equipment such as a kayak skirt 206 (also called a spray skirt or cockpit cover), and FIG. 2B adds the first device 100 to the same equipped kayak 200. The first device 100 is placed at an attachment point 202, chosen by the user, along the cockpit lip 204 by hooking the attachment end 104 over the inside of the cockpit lip 204 and fitting the curve 108 of the first device 100 around the top and outside raised portion of the cockpit lip 204, allowing the fixed tool end 106 to stick out toward the outside of the craft, as presented in FIG. 2B. In this image the shape of the fixed tool end 106 is left generic, as the positioning of the device upon a watercraft is the focus. It is noted that the user might choose any attachment point 202 around the cockpit lip 204, and additionally noted that a single shape of attachment end 104 won't necessarily fit every possible or available shape of cockpit lip 204 and additional embodiments of the invention might include different shapes of attachment end 104 suitable for various craft, as presented also in FIGS. 5A and 5B. Additionally, though, and pertaining to selection of attachment point 202, a circular kayak cockpit could probably have the invented device attached at any point around the circle, but if the shape of the cockpit lip 204 is a less uniform shape such as an ellipsoid, for instance, with the narrower ends pointing fore and aft and the pilot sitting in the widest part at the center of the oval, an alternate attachment end 104 variation might even be preferred for attaching the invented device at the front or back of the cockpit (that is, facing toward either the bow or stern of the kayak 200) as opposed to on either side, as the arc formed by the cockpit edge 204 sharpens at the front and back. Other shapes of cockpit besides ellipsoid might also, of course, include similar variation in size or shape of attachment points 202 requiring or preferring alternative shapes of attachment end 104 for an ideal and secure fit; the scenario of attaching the invented device at a narrow end on an ellipsoid cockpit edge 204 is just one relevant example, and another might be a diamond-shaped kayak cockpit edge 204, if any such thing exists or is ever implemented in the future, wherein one might require a first attachment end 104 shape in order to attach to either the fore or aft (narrow) point of the diamond; a second that fits either the port or starboard (broad) point of the diamond; and/or a third that fits over one of the flat sides of the diamond between the four points. Someone skilled in the art can easily realize the basic and obvious compatibility concern represented in the variation and proliferation of possible attachment end 104 shapes, but will also recognize that all of these variations would share the common quality of being shaped to fit some suitable attachment point 202. The kayak skirt 206 has an edge 208 (also called a rand) that fits around the cockpit lip 204 as is secured there by conventional prior art means such as elastic or a drawstring. When using the invention, the skirt edge 208 is fastened by placement of the skirt edge around the cockpit lip as usual, and over the first device 100 at the attachment point 202, with the curve 108 fitting over the raised portion of the cockpit lip 204 and presenting a similar shape to that of the raised portion of the cockpit lip 204 such that the edge 208 can be placed and secured both around the cockpit lip 204 and under the curve 108 by prior art means such as elastic or a drawstring, and the raised portion of the cockpit lip 204 and the curve 108 will hold the skirt edge 208 in place while in use. It should be understood overall, as presented in FIG. 2B, that the edge 208 of the kayak skirt 206 covers the attachment end 104 of the first device 100 and fits over the curve 108 in the body 102 of the first device 100 as discussed, and the fixed tool end 106 of the first device 100 extends beyond the edge 208 of the kayak skirt 206, making any tool offered by the fixed tool end 106 attachment available to the pilot of the kayak 200.

Figure 3:
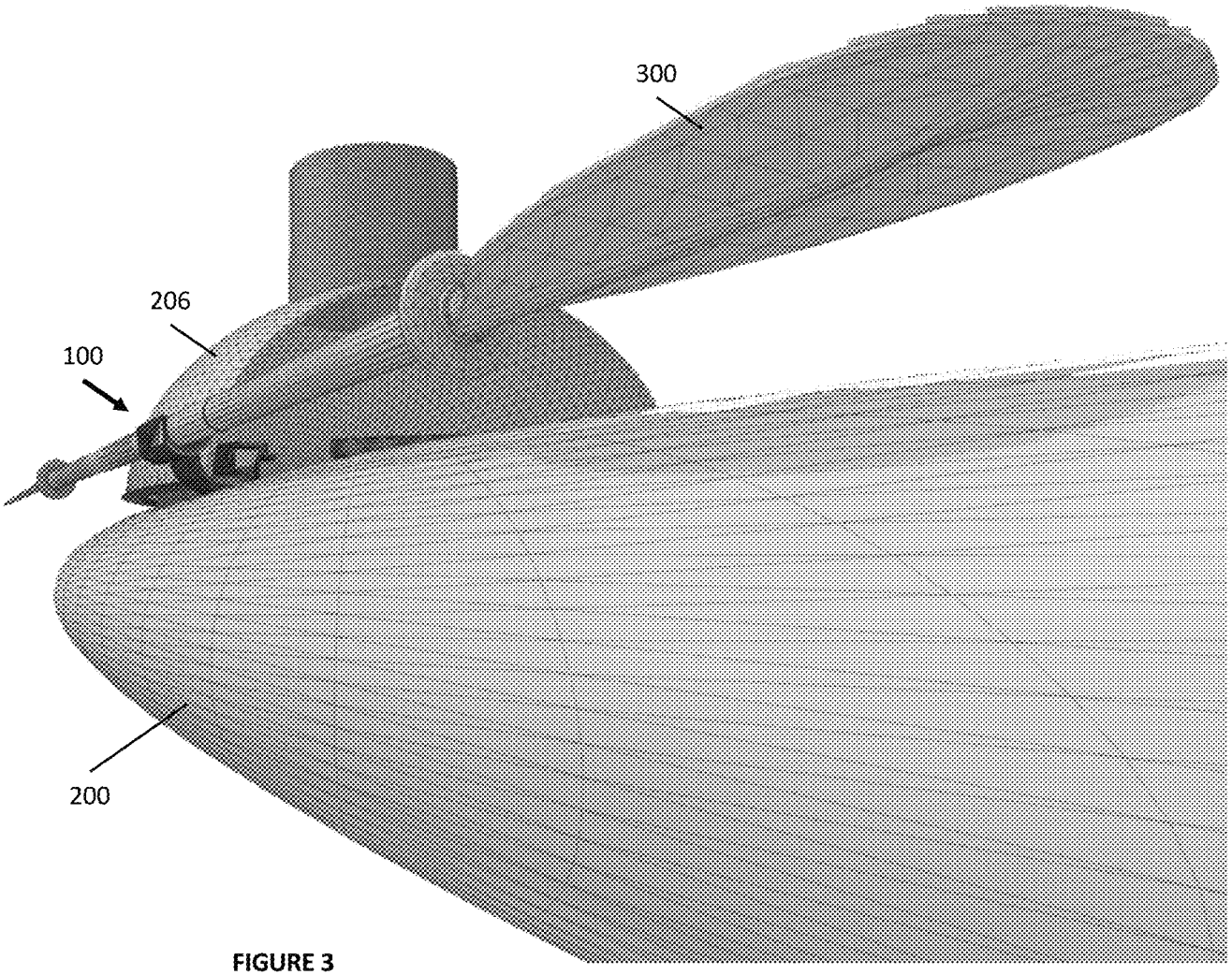
FIG. 3 is a 3D model of the device-equipped kayak of FIG. 2B, additionally equipped with a paddle held by the device of FIG. 1.

Referring now generally to the Figures and particularly to FIG. 3, FIG. 3 presents an additional view of the kayak 200, now fully equipped with the first device 100 extending from underneath the skirt 206 and presenting the fixed tool end 106 into which is placed a kayak paddle 300.

Figure 4:
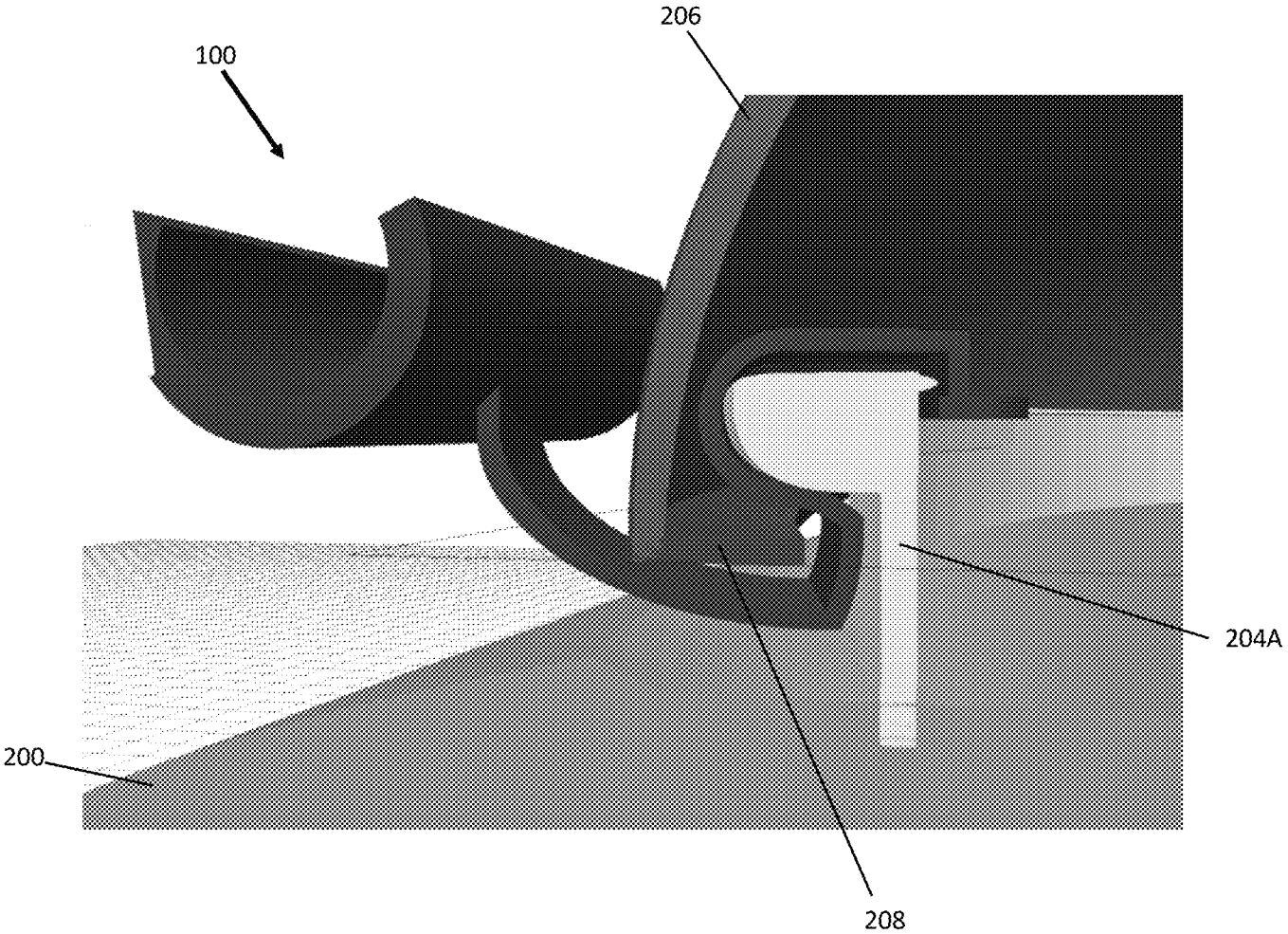
FIG. 4 is an additional, closer view of the device-equipped kayak 3D model of FIG. 2B.

Referring now generally to the Figures and particularly to FIG. 4, FIG. 4 is an additional close-up view of the first device 100 attached to the kayak cockpit lip 204 under the edge 208 of the kayak skirt 206. As alternative shapes of cockpit lip 204 are about to be presented in FIGS. 5A and 5B, along with attachment ends 104 to fit those cockpit lips 204 instead, this particular shape of cockpit lip is presented also as a first cockpit lip 204A. It should be understood that all lettered cockpit lip shapes 204A-Z named herein are subcategories and instances of cockpit lip 204.

Figure 5A:
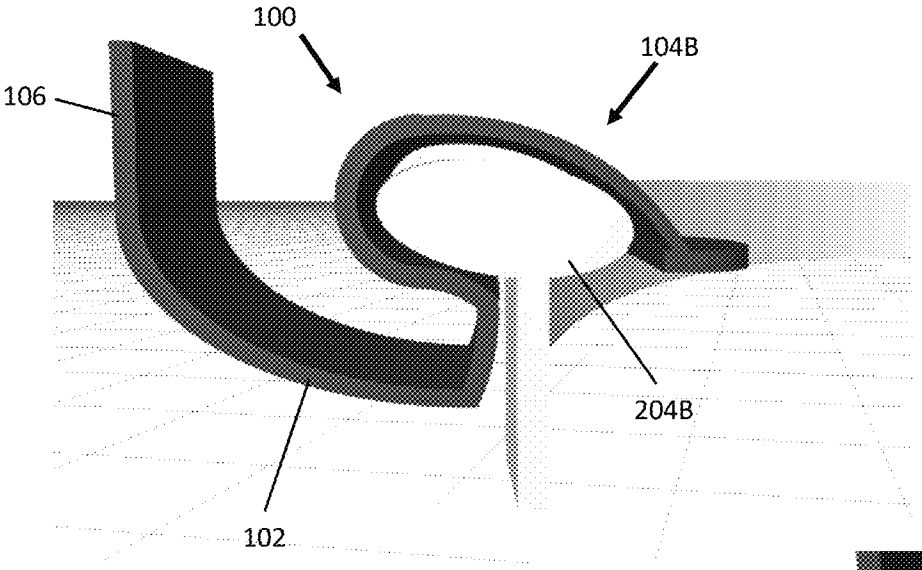
FIG. 5A is a 3D model showing a first alternative shape for the attachment end of the device of FIG. 1.
Figure 5B:
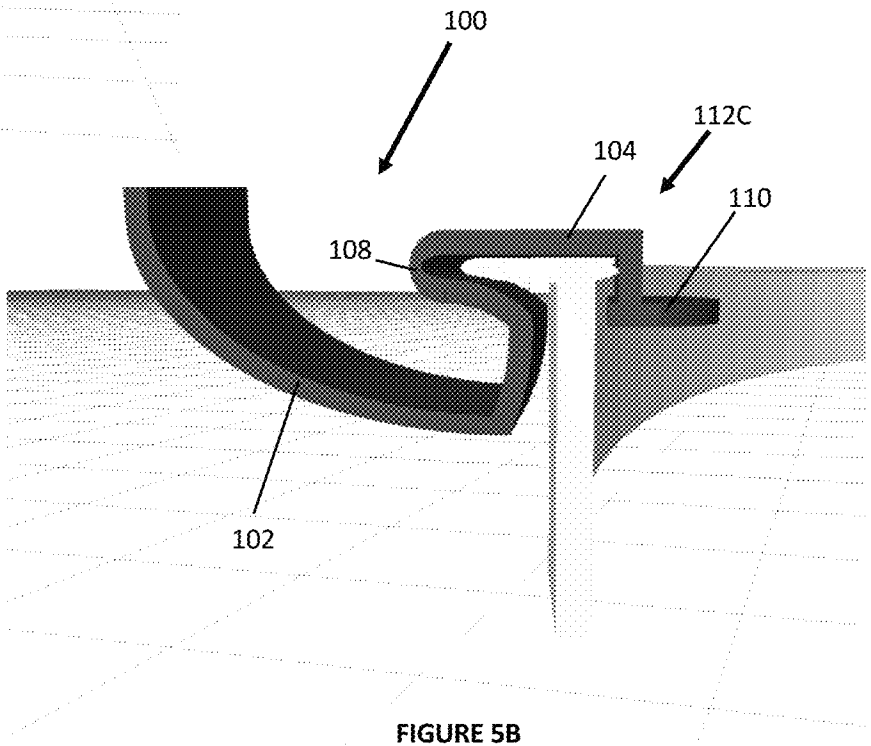
FIG. 5B is a 3D model showing a second alternative shape for the attachment end of the device of FIG. 1.

Referring now generally to the Figures and particularly to FIGS. 5A and 5B, FIGS. 5A and 5B present two alternative shapes of cockpit lip 204, and additional embodiments of the first device 100 wherein the attachment end 104 of the first device 100 is shaped differently to fit these differently shaped cockpit edges 204. In these images the fixed tool end 106 is not shown or left as an indistinct shape, as the attachment end 104 is the portion under discussion and, as later Figures will show, the fixed tool end 106 might take many different shapes also. Presented in FIG. 5A is a second attachment end 104B fitting over a second cockpit lip 204B, and presented in FIG. 5B is a third attachment end 104C fitting over a third cockpit lip 204C.

Figure 6B:
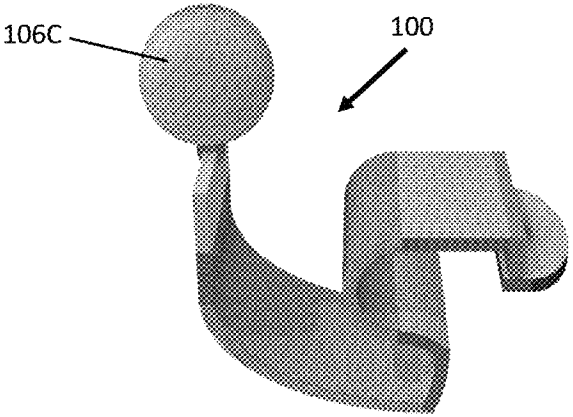
FIG. 6B is a 3D model showing a possible optional embodiment for the tool end of the device of FIG. 1.
Figure 6D:
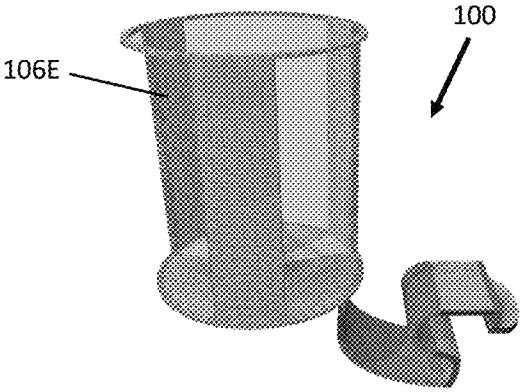
FIG. 6D is a 3D model showing a possible optional embodiment for the tool end of the device of FIG. 1.
Figure 6A:
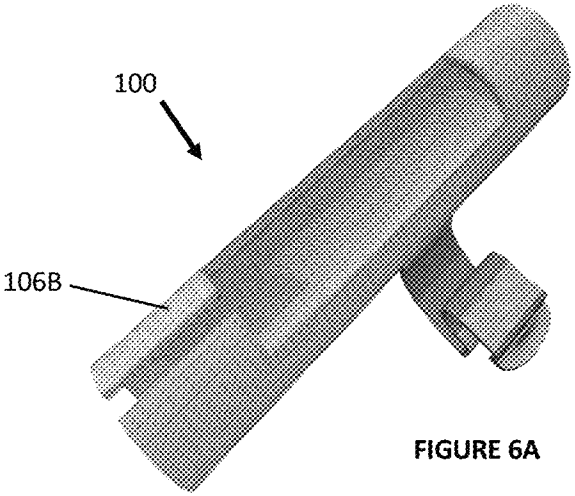
FIG. 6A is a 3D model showing a possible optional embodiment for the tool end of the device of FIG. 1.
Figure 6C:
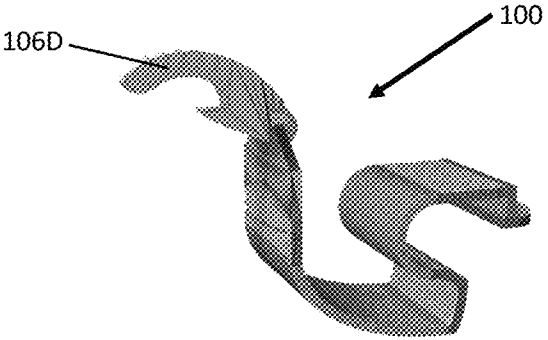
FIG. 6C is a 3D model showing a possible optional embodiment for the tool end of the device of FIG. 1.

Referring now generally to the Figures and particularly to FIGS. 6A through 6D, FIGS. 6A through 6D present four additional embodiments of the invented first device 100 wherein the fixed tool end 106 is shaped differently to provide different tools. In prior images, the paddle holder fixed tool end 106A presented has been a C-shape, suitable as a paddle holder or holder for another tool of similar size (such as perhaps a flashlight). Presented in FIG. 6A is a device 100 with a fishing pole fixed tool end 106B shaped to hold a fishing pole. Presented in FIG. 6B is a device 100 with a connector fixed tool end 106C shaped as an attachment point compatible with attachable tool ends manufactured for another prior art device. FIG. 6C presents a bottle opener fixed tool end 106D shaped as a bottle opener. FIG. 6D presents a cup holder fixed tool end 106E shaped as a cup holder. It should be noted that variety of tool ends 106 is not limited to these, further variations are obvious and also presented in later Figures, and the fixed tool end 106 might be shaped to offer any kind of fixed tool end 106 function.

Figure 7A:
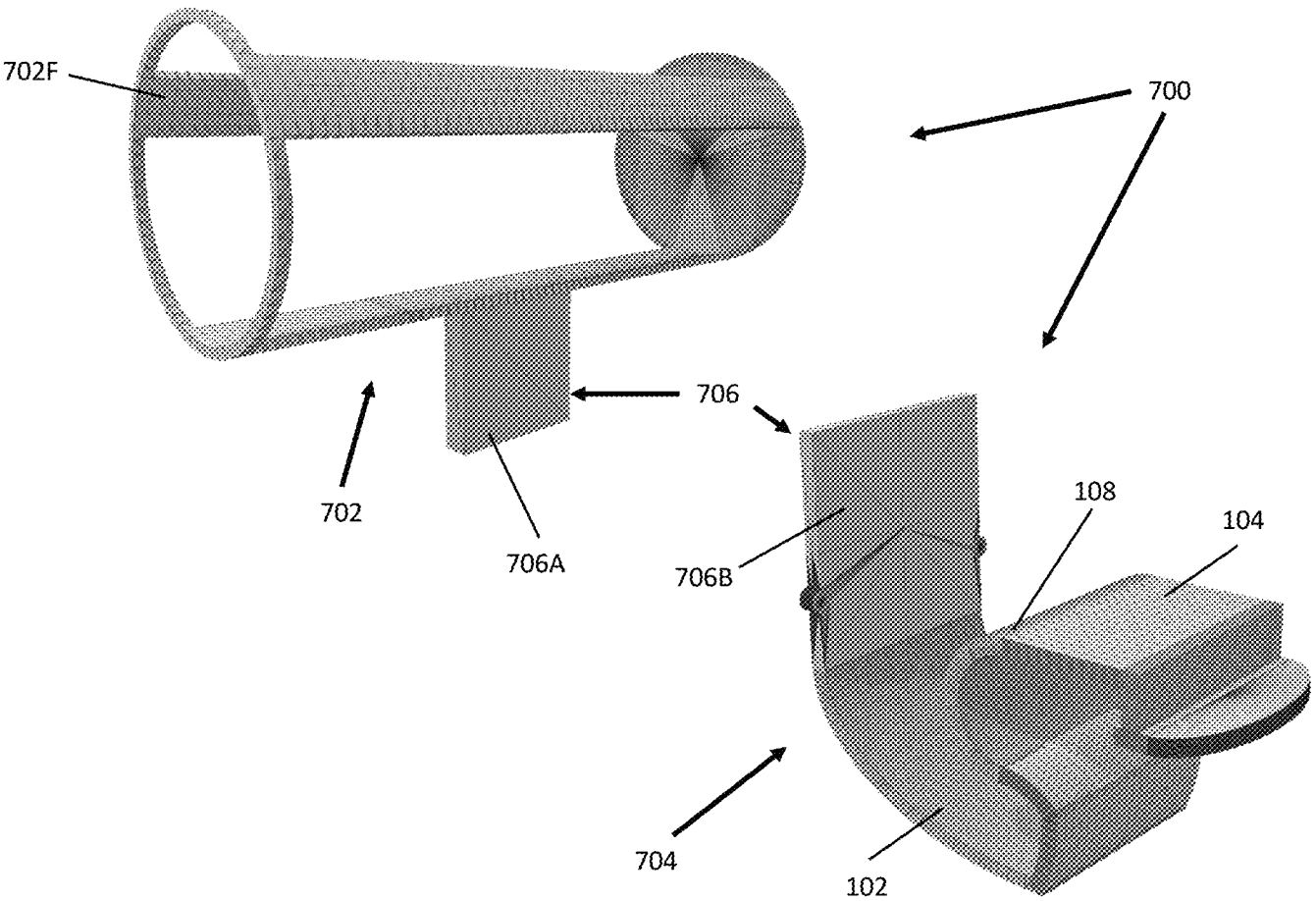
FIG. 7A is a 3D model of a second embodiment of the invented device where the tool end is attachable, presented in a detached state.

Referring now generally to the Figures and particularly to FIG. 7A, FIG. 7A presents a second device 700 wherein an attachable tool end 702 is detachable from the rest of the device 700. Presented here is an attachable water bottle holder tool end 702E, and an attachable device body 704 onto which this tool end 702 detachably attaches by means of a tool end fastener assembly 706 consisting of a tool side fastener 706A and a body side fastener 706B that couple detachably together. The fastener assembly 706 might be structured in any suitable fashion known in the art for attaching two pieces of a device shaped like the device 700 together; presented herein is an assembly consisting of a thin sleeve-shaped tool side fastener 706A that fits over a thin body side fastener 706B piece that 'clicks into' the sleeve shape. Throughout, this description, several variations on the shape of an attachable tool end 702, numbered 702A-Z, will be discussed; the attachable water bottle holder tool end 702E is the first in this series. All attachable tool end variations 702A-Z should be considered subcategories of attachable tool end 702. Further, all variations of fixed tool end 106A-Z might also be variations of attachable tool end A-Z, and vice versa; it should be understood at this point that the tool end variations 106A-D already presented might also be instantiated as attachable tool end variations 702A-D having the same shape, which is why the attachable water bottle holder tool end 702E is not lettered A, despite being the first attachable tool end 702 variation presented. Additionally, it should be noted that the second device 700 still incorporates all other aspects previously introduced as part of the first device 100 as shown, such as the body 102 and attachment end 104; the only difference is that the tool end 702 is now a detachably attachable piece, so one might have multiple tool ends 702 to customize the same device 700.

Figure 7B:
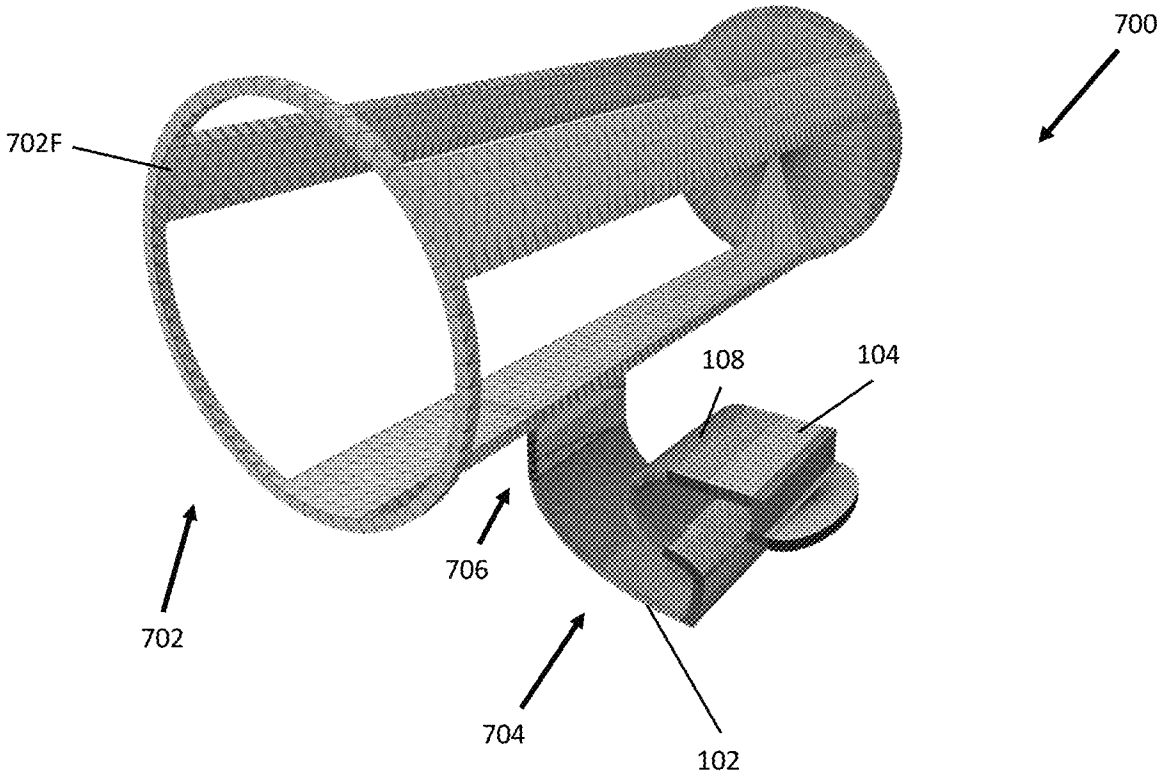
FIG. 7B is a 3D model of the second embodiment of the invented device of FIG. 7A, in an attached state.

Referring now generally to the Figures and particularly to FIG. 7B, FIG. 7B presents the second device of FIG. 7A, now with the pieces coupled together to form a complete device 700. When the second device 700 is in an attached state, the second device 700 may be used interchangeably with the first device 100 in all of the same applications.

Figure 7D:
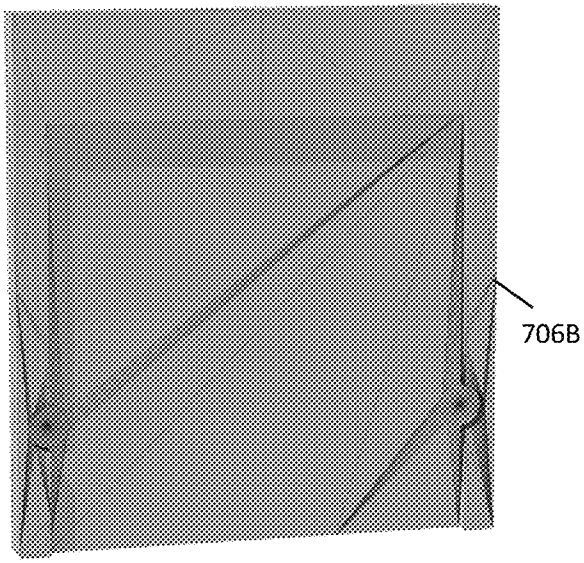
FIG. 7D presents the body section of the second invented device of FIG. 7A from an additional angle.
Figure 7F:
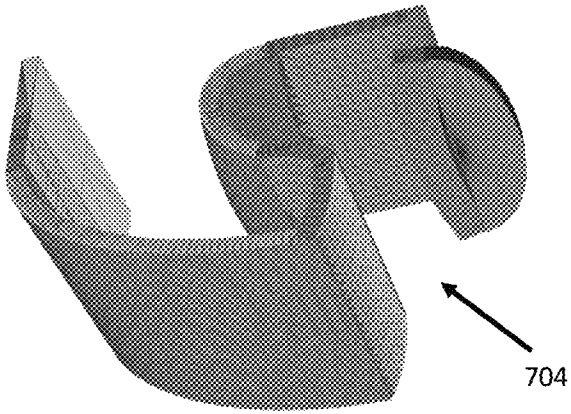
FIG. 7F presents the body section of the second invented device of FIG. 7A from an additional angle.
Figure 7C:
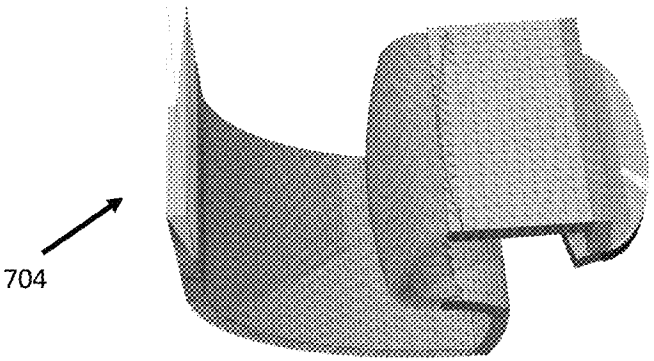
FIG. 7C presents the body section of the second invented device of FIG. 7A from an additional angle.
Figure 7E:
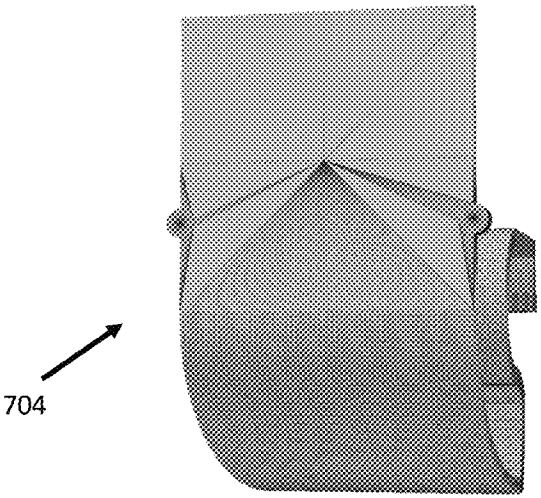
FIG. 7E presents the body section of the second invented device of FIG. 7A from an additional angle.

Referring now generally to the Figures and particularly to FIGS. 7C through 7F, FIGS. 7C through 7F present additional views of the second device 700. FIG. 7C is a top view of the attachable device body 704, without an attachable tool end 702 attached. FIG. 7D is a close-in view of the body side fastener 706B as presented in FIG. 7A. FIG. 7E is a view of the attachable device body 704 without an attachable tool end 702 attached, shown with the body side fastener 706B pointed toward the viewer. FIG. 7F is a view from below of the attachable device body 704 without an attachable tool end 702 attached.

Figure 8B:
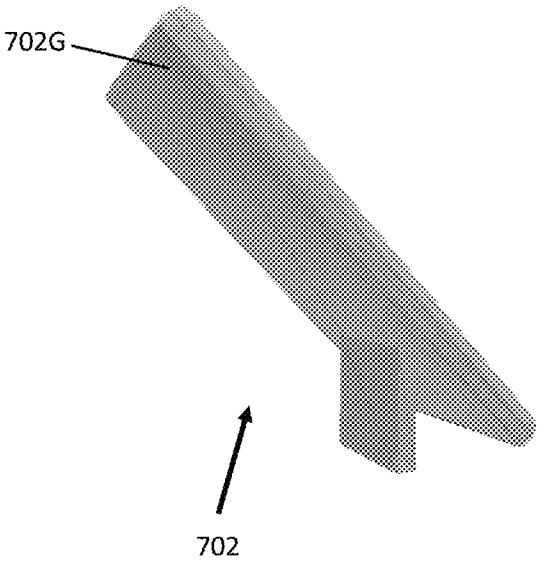
FIG. 8B is the second of two 3D models of a further additional tool end option, presented in FIG. 8A as a unitary device of FIG. 1, and in FIG. 8B as an attachable tool end of the second device of FIGS. 7A through 7E.
Figure 8A:
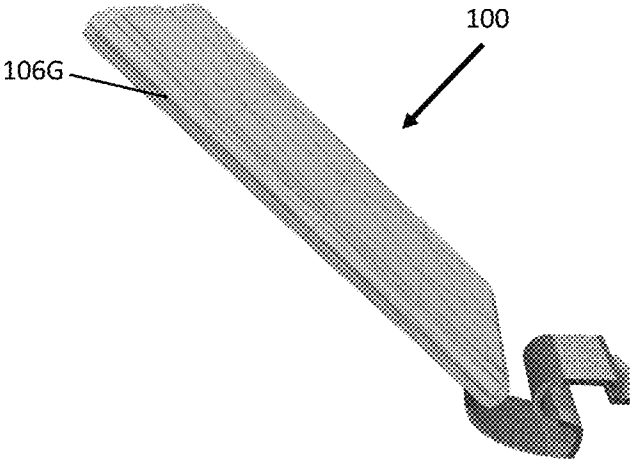
FIG. 8A is the first of two 3D models of a further additional tool end option, presented in FIG. 8A as a unitary device of FIG. 1, and in FIG. 8B as an attachable tool end of the second device of FIGS. 7A through 7E.

Referring now generally to the Figures and particularly to FIGS. 8A and 8B, FIGS. 8A and 8B present, side-by-side, the same tool end version as part of the first device 100 (FIG. 8A) and as an attachable tool end 702 for the second device 700 (FIG. 8B). This shape of the fixed tool end 106G and the attachable tool end 702G is meant as a holder for a phone or tablet, or perhaps a flat surface to clip a map or notepad onto. Again, it should be noted that any tool shape embodiment used for the attachable tool end 702 could also be an embodiment of the fixed tool end 106, and vice versa.

Figure 8C:
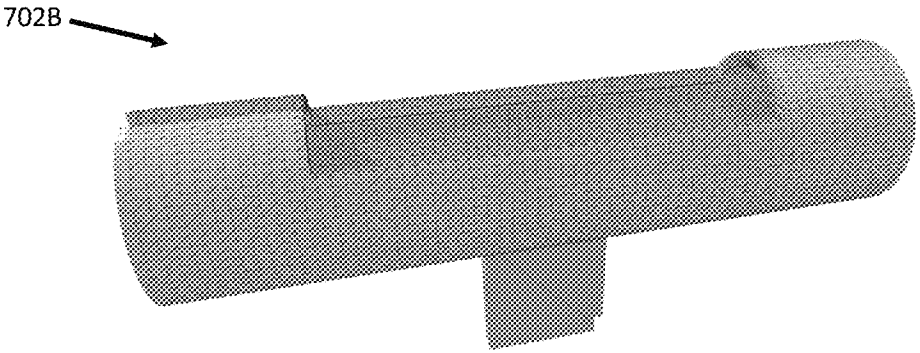
FIG. 8C is a 3D model of a further additional attachable tool end option, presented as an attachable tool end of the second device of FIGS. 7A through 7E.
Figure 8E:
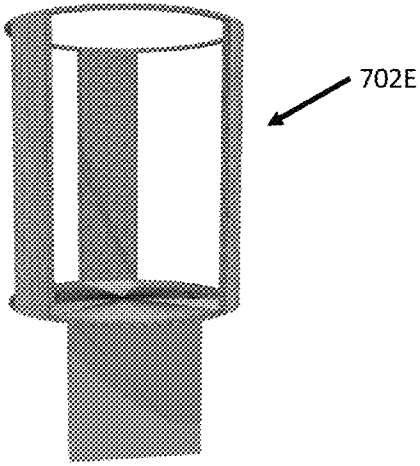
FIG. 8E is a 3D model of a further additional attachable tool end option, presented as an attachable tool end of the second device of FIGS. 7A through 7E.
Figure 8D:
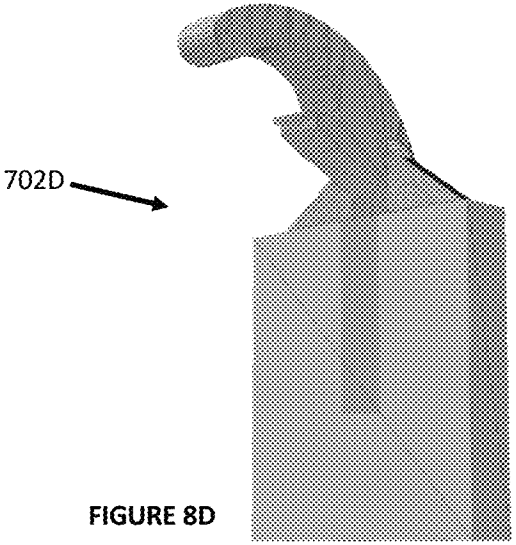
FIG. 8D is a 3D model of a further additional attachable tool end option, presented as an attachable tool end of the second device of FIGS. 7A through 7E.

Referring now generally to the Figures and particularly to FIGS. 8C through 8E, FIGS. 8C through 8E continue to illustrate the point that any shape of the fixed tool end 106 may also be a shape for the attachable tool end 702. FIG. 8C presents an attachable fishing pole tool end 702B, matching the fishing pole tool end 106B of FIG. 6A. FIG. 8D presents an attachable bottle opener tool end 702 matching the bottle opener fixed tool end 106B of FIG. 6C. FIG. 8E presents an attachable cup holder tool end 702E matching the cup holder fixed tool end 106E of FIG. 6D.

Figure 9:
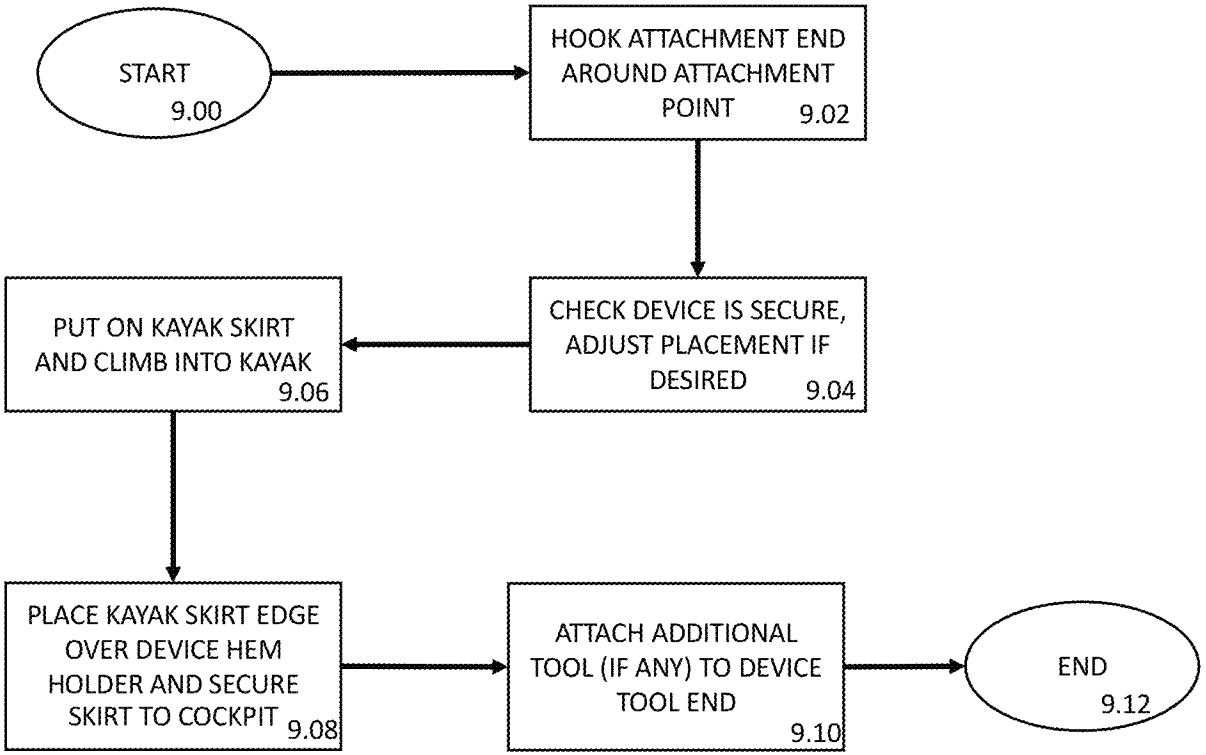
FIG. 9 is a process chart detailing a method for attaching the invented device of FIG. 1 to a watercraft.

Referring now generally to the Figures and particularly to FIG. 9, FIG. 9 is a flowchart presenting a method for attaching the device of the Figures to one's kayak and attaching the kayak skirt over the invented device (i.e. either the first device 100, the second device 700, or some alternative embodiment of the invention not presented herein) as described herein. In step 9.00 the process starts. In step 9.02 a user attaches any embodiment of the first device 100 or second device 700 to the attachment point 202 on the watercraft 200. In step 9.04, the user may ensure the first device 100 or second device 700 is securely attached or adjust the placement, by a method such as wiggling or carefully pulling on the placed first device 100 or second device 700 to test stability or adjust positioning. A knowledgeable person will recognize such techniques as standard in any art wherein something needs to be fitted or placed onto something else. Once the first device 100 or second 700 has been placed to the user's satisfaction, in step 9.06 the user dons the kayak skirt 206 and enters the watercraft 200 as one usually would. It should be noted that placing the invented first device 100 or second device 700 is not, of course, a prerequisite for donning a kayak skirt 206, and in some embodiments, the first device 100 or second device 700 may be easy enough to place (and the user sufficiently experienced to be certain of this) once one is sitting in the watercraft 200; this order of steps should not be considered the only possible method of accomplishing this, but rather only one possible process for successfully doing so, and probably easiest for a new user. As a point of order, though, the first device 100 or second device 700 goes partially underneath the kayak skirt, and therefore should be emplaced first. In step 9.08, with the first device 100 or second device 700 emplaced and the user sitting in the craft with his or her kayak skirt on, the edge 208 of the kayak skirt 206 is then fitted around the cockpit edge 204, and over the curve 108 of the first device 100 or second device 700, and secured snugly around these coupled elements by suitable standard means known in the art of kayak skirts 300 such as a drawstring or elastic. In step 9.10, the user then attaches anything else meant to attach by means of the device, such as a paddle 300 being placed in the paddle holder attachment or a camera being mounted on the camera mount attachment. Doing this after having climbed into the craft and secured one's kayak skirt 206 is, again, not absolutely compulsory, but probably advisable to prevent getting 'tangled up' too badly, especially if the device is meant to hold something large and unwieldy (like a paddle) or fragile (like a camera). Therefore, it may also be advisable to place this object within reach, or have someone else hand this object to the kayak pilot once situated in the craft. This concern might also be addressed suitably by having the pilot climb into the craft on the opposite side of the cockpit from the attachment point 202. At step 9.12 the process is complete.

Figure 10:
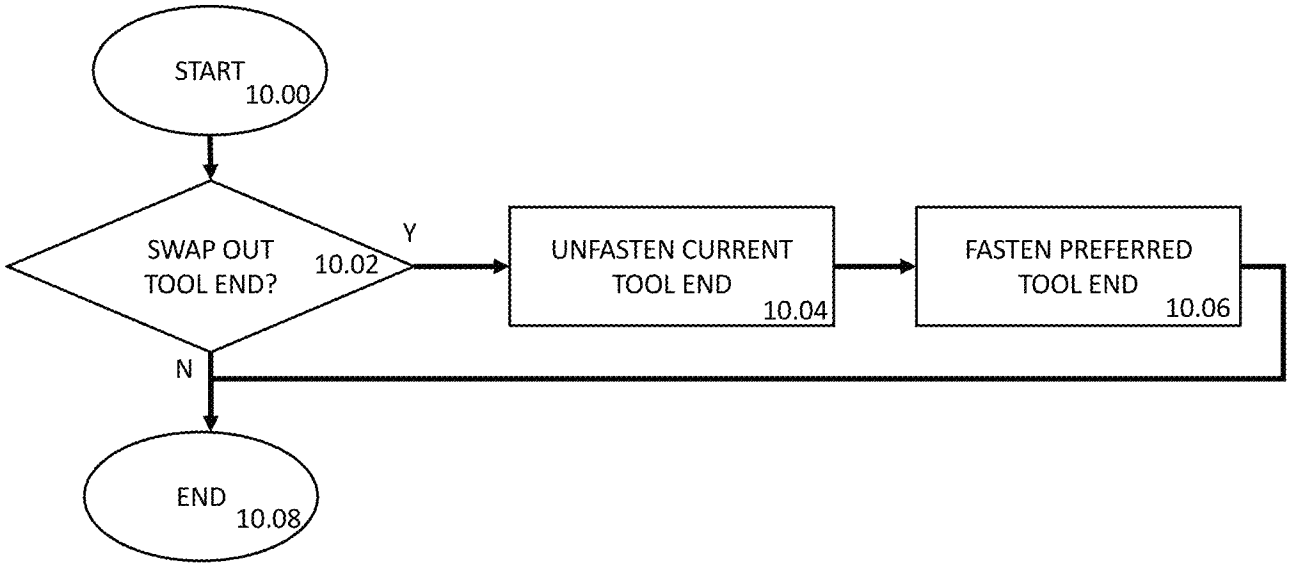
FIG. 10 is a process chart detailing a method for swapping out the attachable device ends of the device of FIGS. 7A and 7B.

Referring now generally to the Figures and particularly to FIG. 10, FIG. 10 is a flowchart presenting a method for changing out the attachable tool end 702 on the second device 700. In step 10.00, the process starts. In step 10.02, the user determined whether to keep whatever attachable tool end 702 (if any) is presently attached. If the user elects to change the attachment end, in step 10.04 the user detaches the unwanted attachable tool end 702, and in step 10.06 the user attaches the preferred attachable tool end 702. In step 10.08 the process is complete, either by having successfully changed the tool end 702 or by having elected to do nothing. It should be noted that the process chart presented assumes that there is already a tool end 702 attached, and the device 700 could also be stored with no tool end attached, which would make step 10.02 an automatic 'yes' (unless the state of having no tool end 702 is actually preferred) and obsoleting step 10.04 (because there is no tool end 702 already there to detach).

Figure 11:
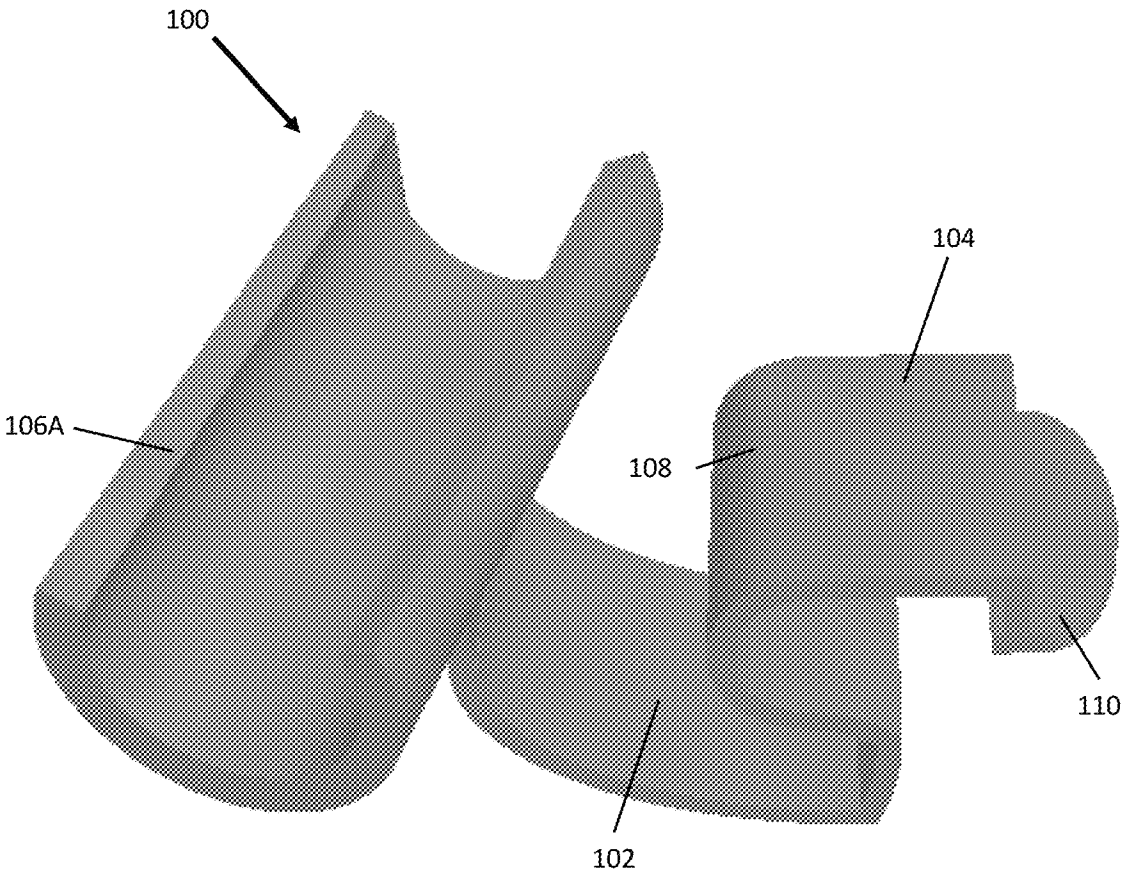
FIG. 11 is an alternate angle view of the device of FIG. 1, presented as a top view.

Referring now generally to the Figures and particularly to FIG. 11, FIG. 11 is a top view of the first device 100 of FIG. 1.

Figure 12:
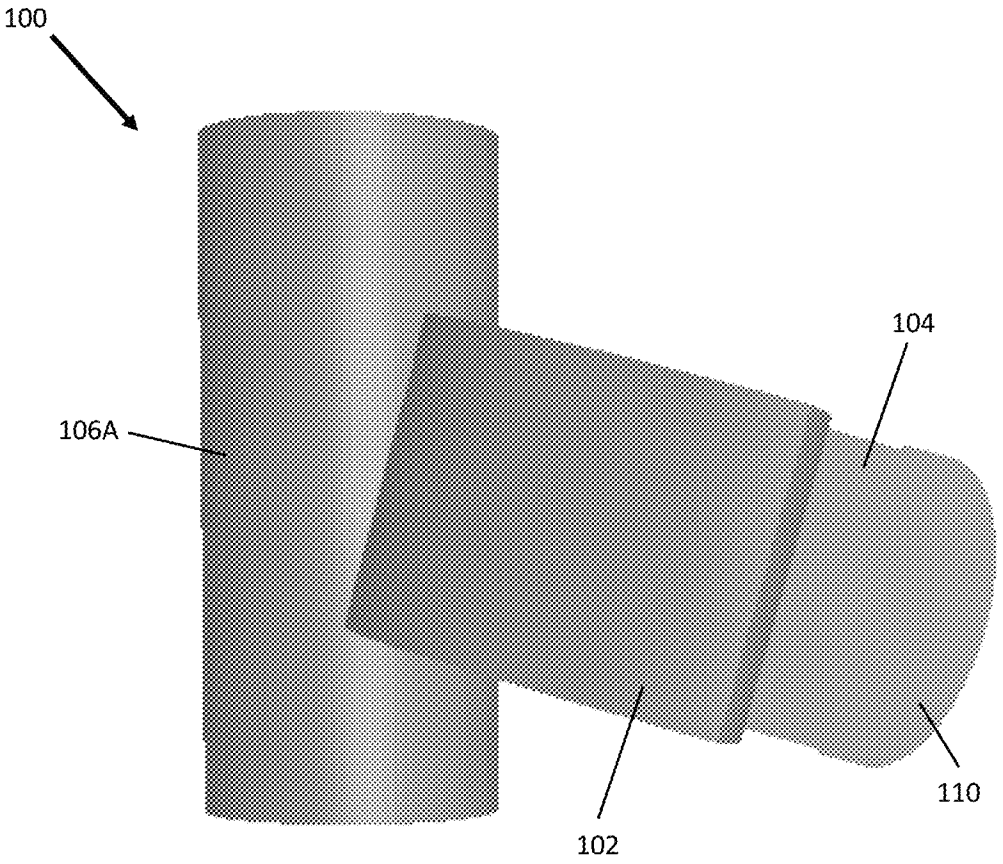
FIG. 12 is an additional alternate angle view of the device of FIG. 1, presented as seen from the bottom.

Referring now generally to the Figures and particularly to FIG. 12, FIG. 12 is a bottom view of the first device 100 of FIG. 1.

Figure 13:
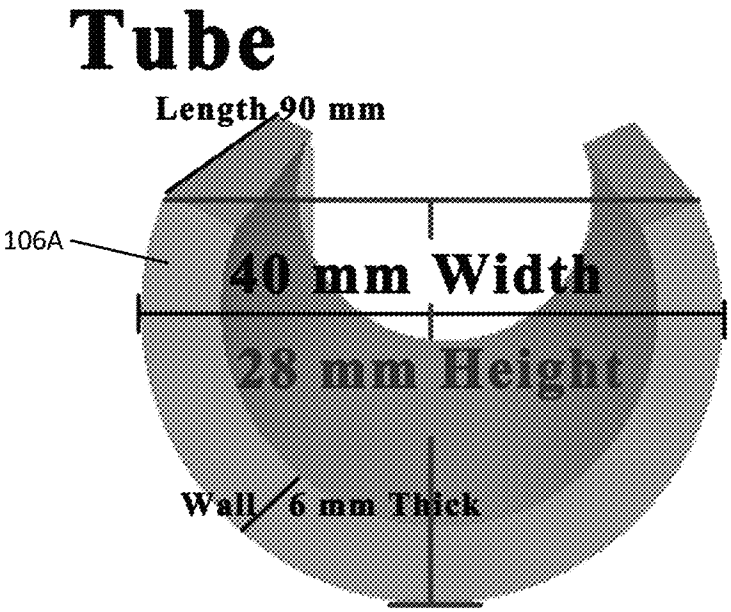
FIG. 13 is a side view of a C-shaped tool end of at least FIG. 1, presenting also some exemplary measurements.

Referring now generally to the Figures and particularly to FIG. 13, FIG. 13 is a view of the C-shape of the paddle holder fixed tool end 106A of the first device 100 as presented in FIG. 1, including some exemplary measurements for a certain embodiment of the invention. It should be understood that these measurements only make sense for a certain fit and scale, and other sizes and shapes not matching these measurements as presented may also embody the present invention as claimed. In this Figure, the C shape of the paddle holder tool end 106A has a length of 90 mm, a width of 40 mm at its widest point, a height of 28 mm, and the wall of the C shape has a thickness of 6 mm.

Figure 14:
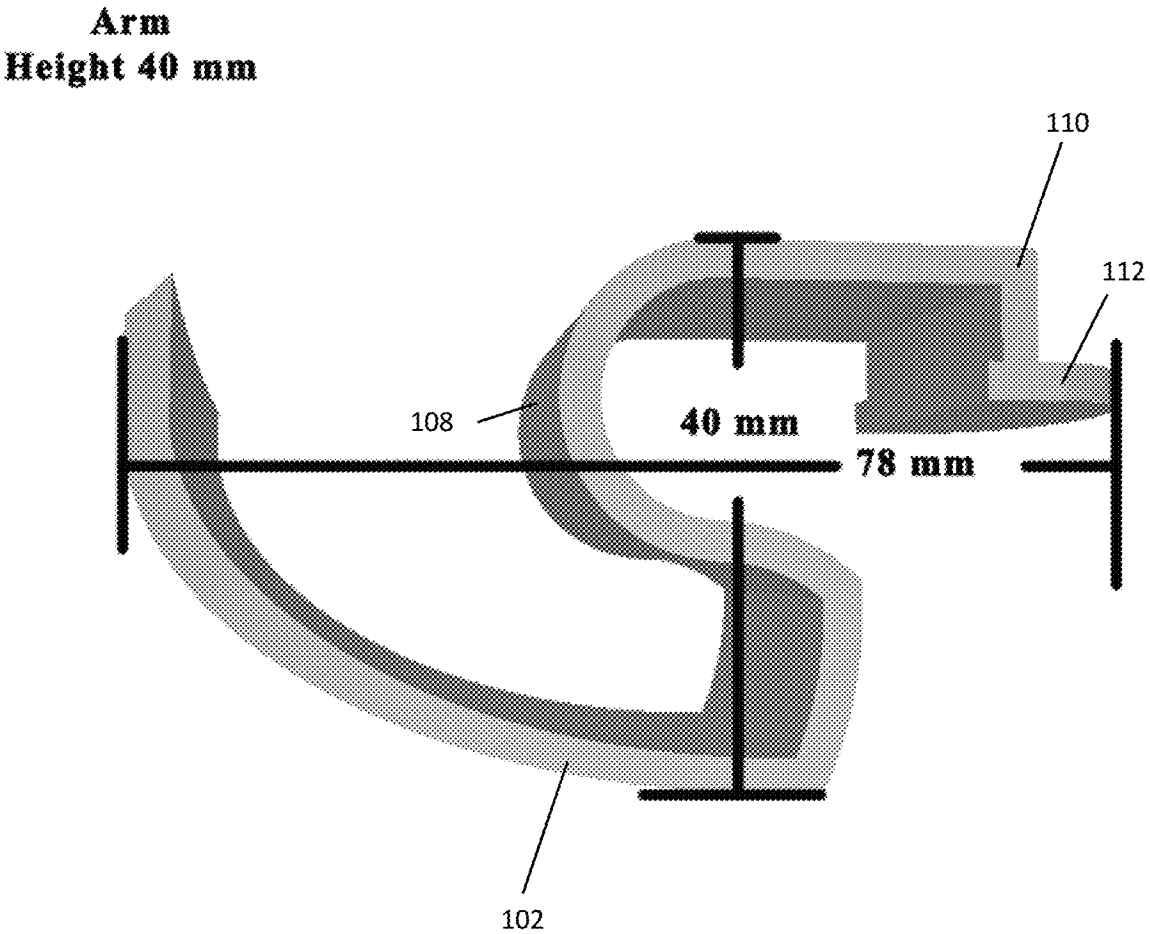
FIG. 14 is a side view of the body of the device of FIG. 1, presenting also some exemplary measurements.

Referring now generally to the Figures and particularly to FIG. 14, FIG. 14 is a view of the body 102 of the first device 100 as presented in FIG. 1, including some exemplary measurements for a certain embodiment of the invention. It should be understood that these measurements only make sense for a certain fit and scale, and other sizes and shapes not matching these measurements as presented may also embody the present invention as claimed. In this Figure, the body shape is 78 mm wide at its widest point as shown, and 40 mm tall.

Figure 15:
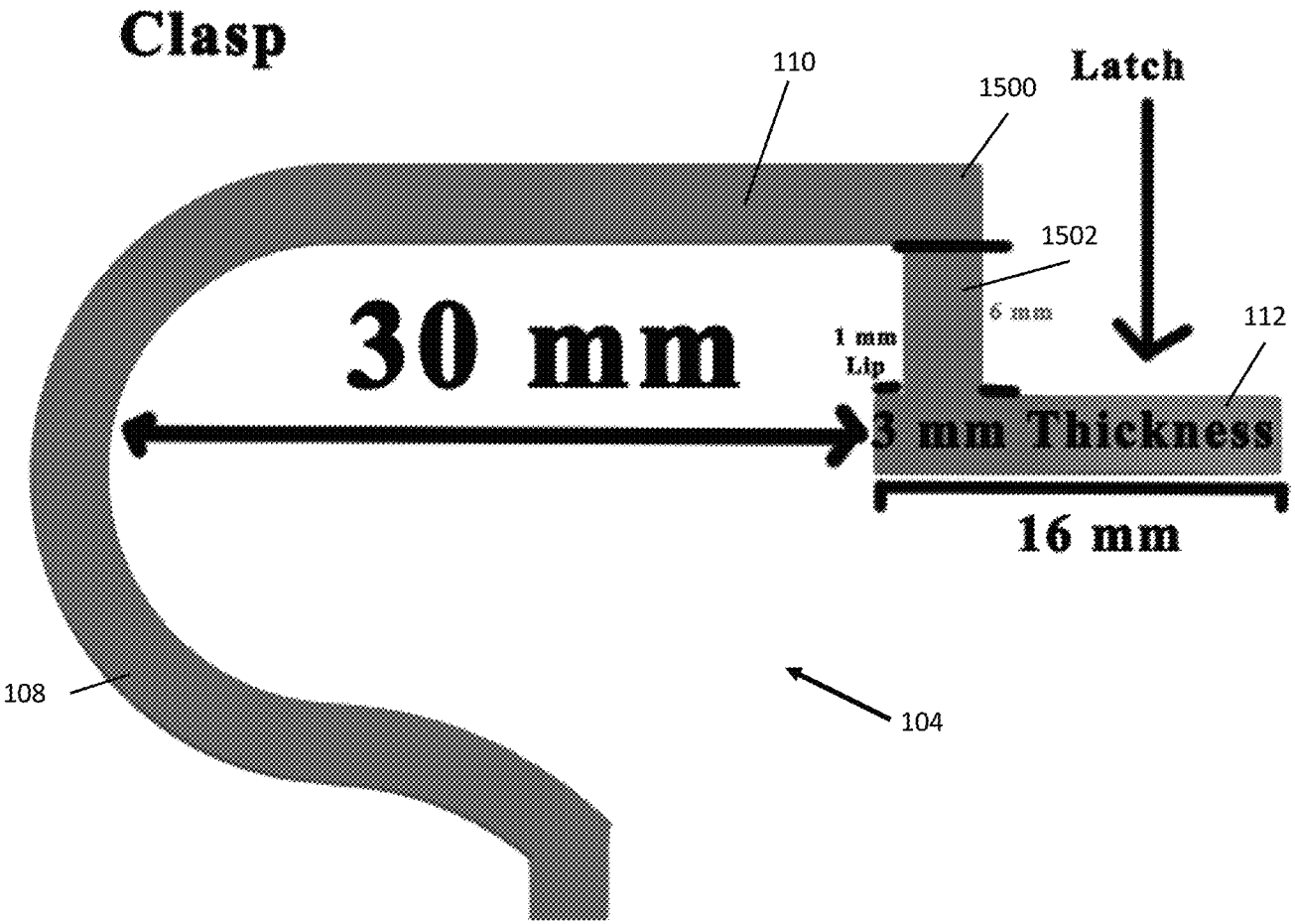
FIG. 15 is a diagram of the attachment end of the device of FIG. 1, presenting also some exemplary measurements.

Referring now generally to the Figures and particularly to FIG. 15, FIG. 15 is a diagram of the first attachment end 104A of the first device 100 as presented in FIG. 1, including some exemplary measurements for a certain embodiment of the invention. It should be understood that these measurements only make sense for a certain fit and scale, and other sizes and shapes not matching these measurements as presented may also embody the present invention as claimed. In this diagram, the distance between the inside face of the curve 108 and the end of the latch 112 is 30 mm as shown. The attachment end 104 as presented here is shaped as consisting of a corner 1500 forming a right angle downward from the top 110, a length 1502 of 6 mm, and a latch 112 to secure the attachment end 104 around the lip of the watercraft. The latch 112 as presented here is 3 mm thick and 16 mm long, offset to form a T-junction with the length 1302 as shown, with 1 mm of 'lip' pointing toward the hem holder side (toward the outside of the watercraft).

Figure 16:
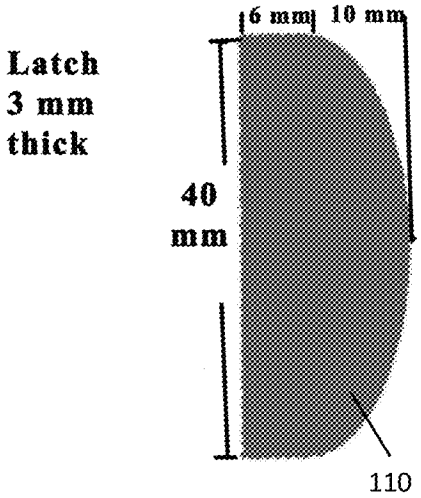
FIG. 16 is a diagram of the latch of FIG. 15, presenting also some exemplary measurements.

Referring now generally to the Figures and particularly to FIG. 16, FIG. 16 is a diagram of the latch 112 of FIG. 15, with additional exemplary measurements presented. It should be understood that these measurements only make sense for a certain fit and scale, and other sizes and shapes not matching these measurements as presented may also embody the present invention as claimed.

Figure 17:
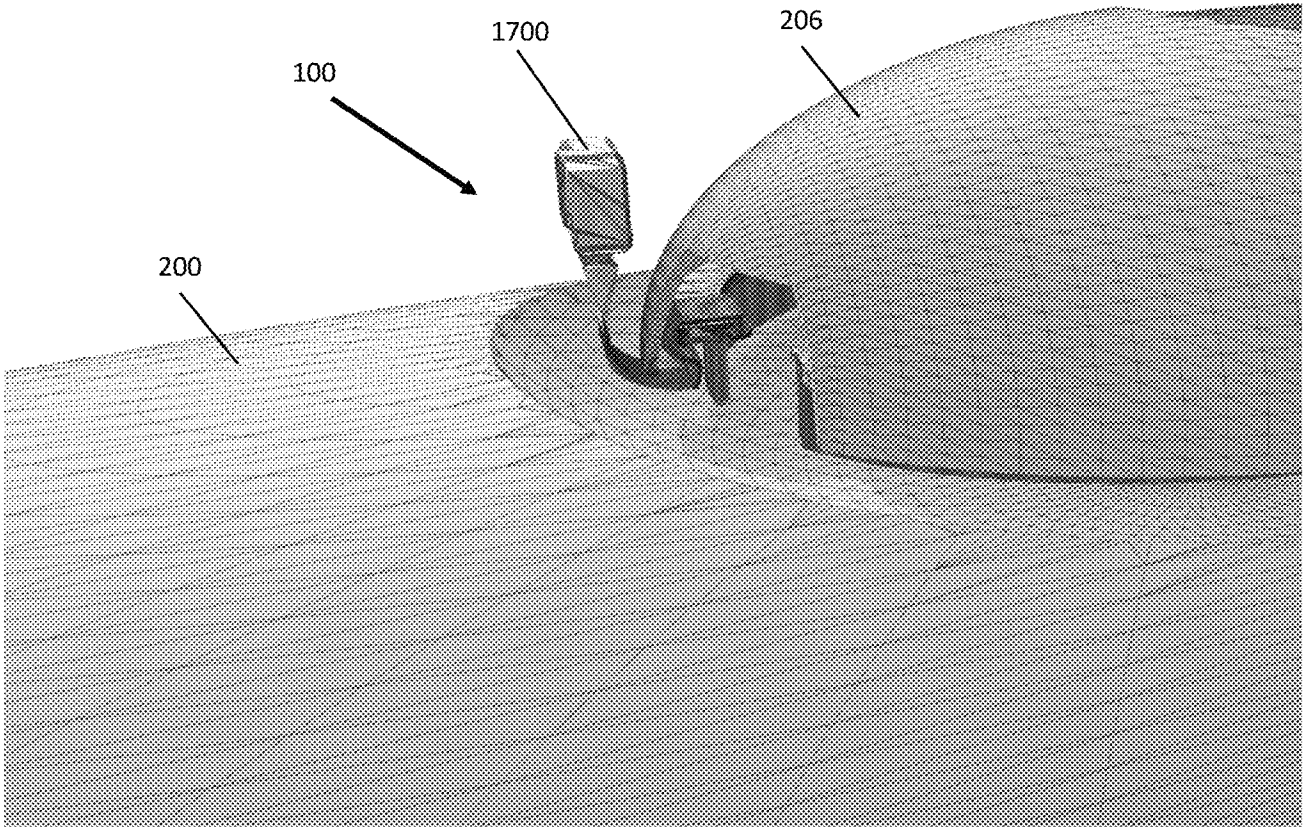
FIG. 17 is a 3D model of the kayak of FIG. 2A, equipped with an embodiment of the device of FIG. 7B wherein the tool end is an apparatus for mounting an action camera onto one's kayak.

Referring now generally to the Figures and particularly to FIG. 17, FIG. 17 is a view of the kayak 200 equipped with an action camera 1700 mounted on a suitably-shaped fixed tool end 106H of a first device 100 or attachable tool end 702 of a second device 700. The kayak skirt 206 in the image is cutaway to show the attachment end 104 hooked around the cockpit lip 204.

Figure 18:
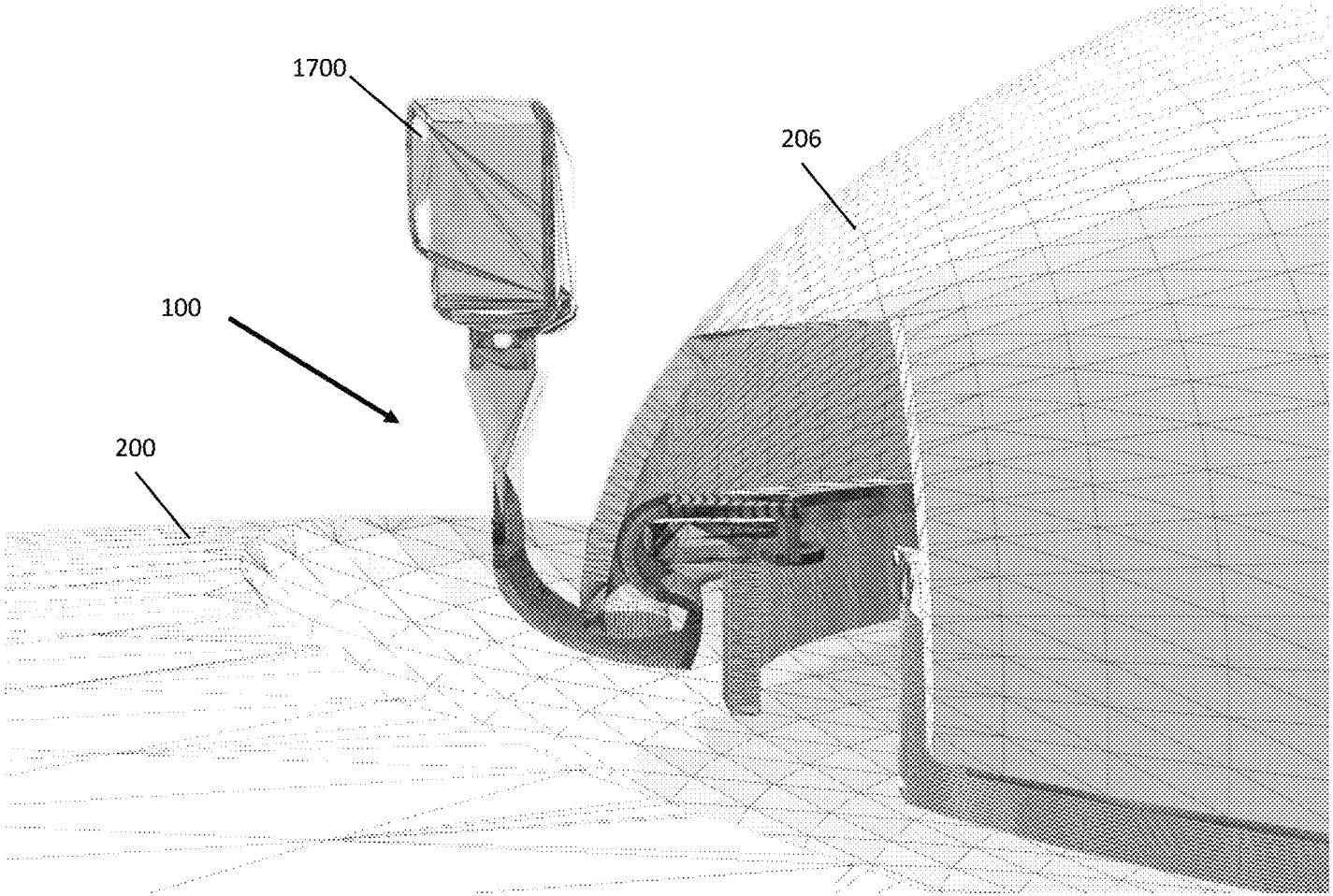
FIG. 18 is a second 3D model of the action camera equipped kayak of FIG. 17.

Referring now generally to the Figures and particularly to FIG. 18, FIG. 18 is an additional, closer view of the kayak 200 equipped with the action camera 1700.

Figure 19B:
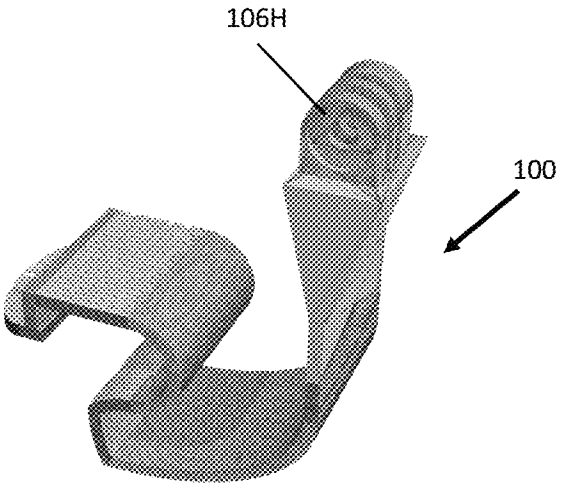
FIG. 19B is a second of five different angles of a 3D model of an embodiment of the device of FIG. 1 or FIGS. 7A and 7B, wherein the tool end option is an attachment point for mounting a certain model of action camera.
Figure 19C:
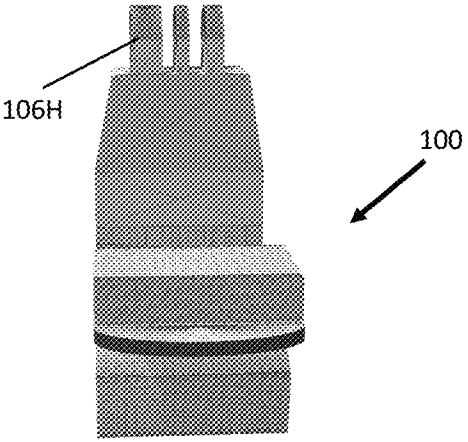
FIG. 19C is a second of five different angles of a 3D model of an embodiment of the device of FIG. 1 or FIGS. 7A and 7B, wherein the tool end option is an attachment point for mounting a certain model of action camera.
Figure 19A:
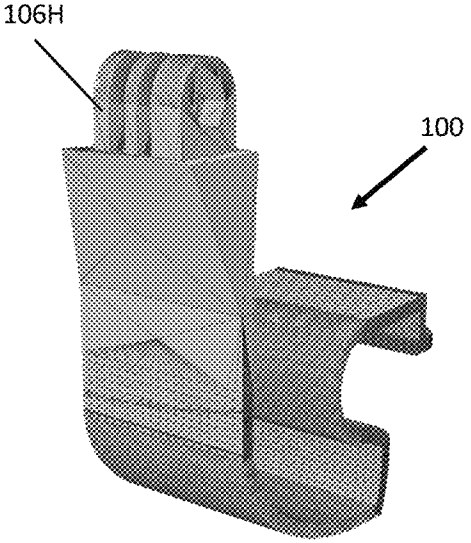
FIG. 19A is a first of five different angles of a 3D model of an embodiment of the device of FIG. 1 or FIGS. 7A and 7B, wherein the tool end option is an attachment point for mounting a certain model of action camera.
Figure 19D:
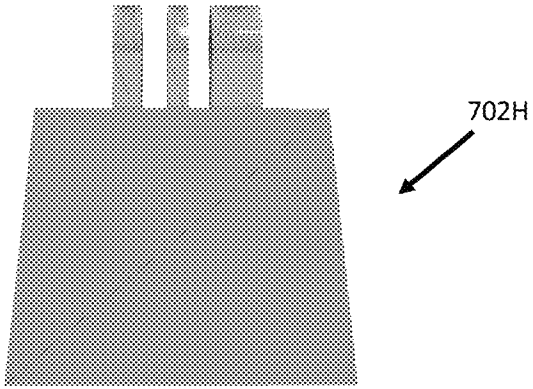
FIG. 19D is a second of five different angles of a 3D model of an embodiment of the device of FIG. 1 or FIGS. 7A and 7B, wherein the tool end option is an attachment point for mounting a certain model of action camera.
Figure 19E:
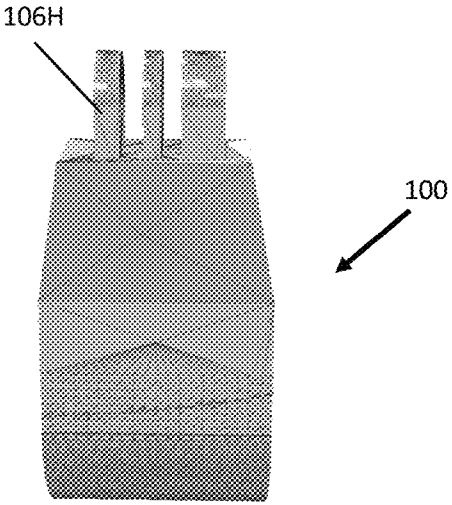
FIG. 19E is a second of five different angles of a 3D model of an embodiment of the device of FIG. 1 or FIGS. 7A and 7B, wherein the tool end option is an attachment point for mounting a certain model of action camera.
Figure 19F:
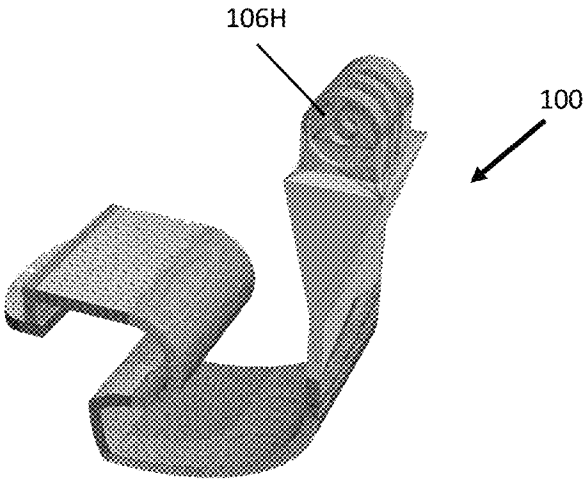
FIG. 19F is a second of five different angles of a 3D model of an embodiment of the device of FIG. 1 or FIGS. 7A and 7B, wherein the tool end option is an attachment point for mounting a certain model of action camera.

Referring now generally to the Figures and particularly to FIGS. 19A through 19F, FIGS. 19A through 19F present a tool end shape for a fixed camera mount tool end 106H (or attachable camera mount tool end 702H) for mounting the action camera 1700. It should be noted that this shape is only one possible for mounting an action camera 1700 and not all action cameras 1700 will necessarily fit this particular shape. FIG. 19A presents a first device 100 with the camera mount shaped fixed tool end 106. FIGS. 19B and 19C present the same first device 100 from other angles. FIG. 19D presents a profile view of the detached attachable camera mount tool end 702H in the same camera mount shape. FIG. 19E presents the second device 700 with the attachable tool end 702H attached, from a further additional angle. FIG. 19F presents the same first device 100 with the camera mount fixed tool end 106H from one more additional angle.

Figure 20:
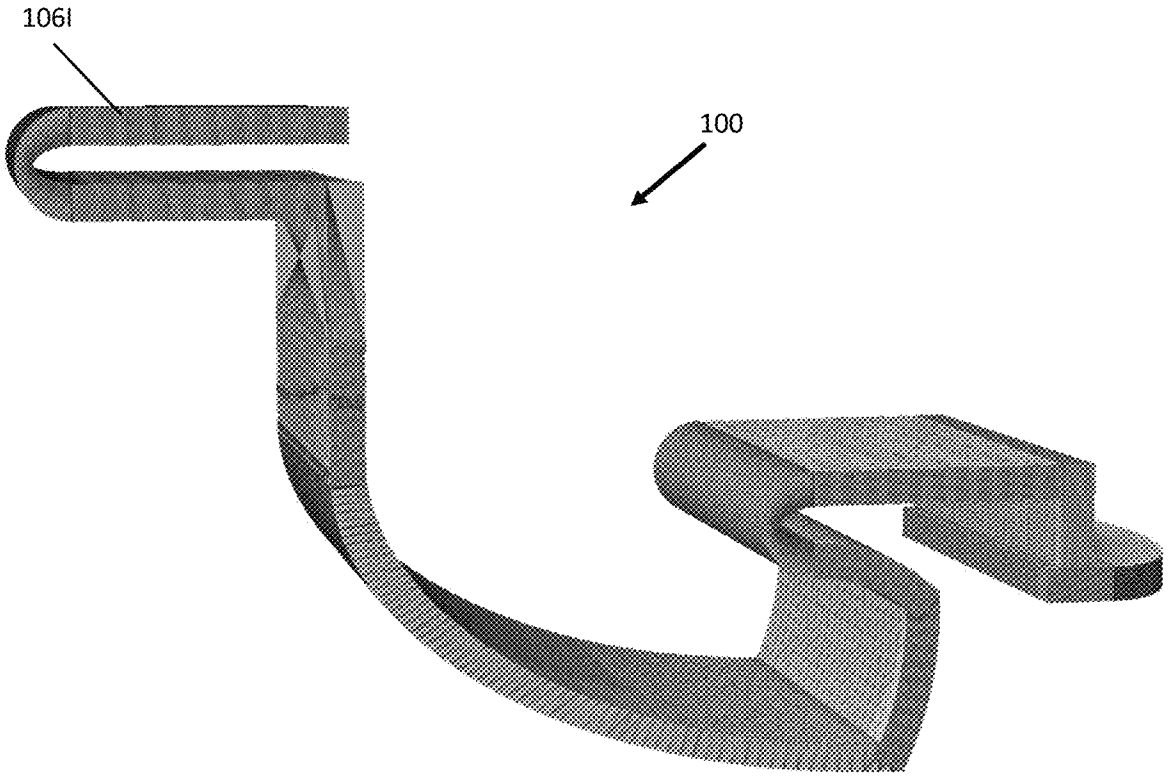
FIG. 20 is a 3D model of an additional variation, presenting a further additional clip tool end variation combined with the attachment end variation of FIG. 5B.

Referring now generally to the Figures and particularly to FIG. 20, FIG. 20 presents another shape for the fixed tool end 106 or the attachable tool end 702, designed for use as a clip or clasp, in this image shaped as a fixed clip tool end 106H for a first device 100. This clasp or clip might be used perhaps as a holder for one's hat brim, or to store a folded map. Additionally, this particular first device 100 or second device 700 in FIG. 20 incorporates the third attachment end 104C, just to provide some variation and accentuate the point that any combination of attached fixed tool end 106 or attachable tool end 702 shape may be combined with any attachment end 104 shape within the scope of the invention; indeed, while certain shapes of both components have predominated in these Figures, there's no 'default standard' shape for either one. The attachment end 104 shape varies by model of watercraft, and the attached fixed tool end 106 or attachable tool end 702 shape varies based on what tool is preferred; just as any tool can be used with any boat (even a kayak paddle with a canoe, if the user really wants to), any combination of attachment end 104 and fixed tool end 106 or attachable tool end 702 should be considered possible, not merely the exact combinations shown and described herein.

Figure 21B:
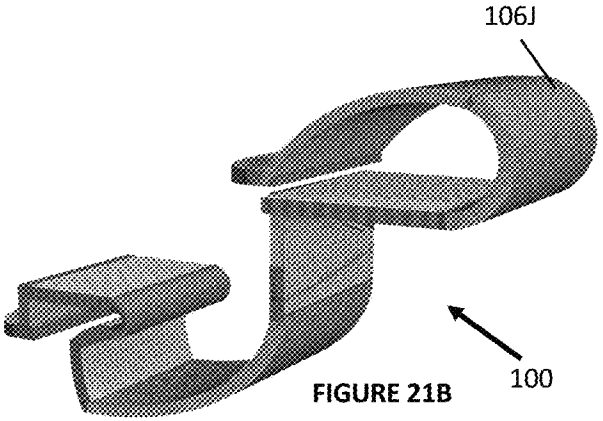
FIG. 21B is a second angle view of a 3D model presenting the further additional clasp tool end variation of FIG. 21A.
Figure 21C:
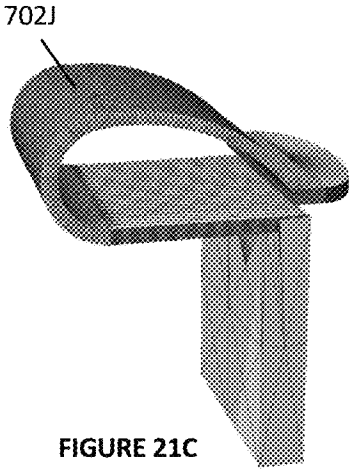
FIG. 21C is a second angle view of a 3D model presenting the further additional clasp tool end variation of FIG. 21A.
Figure 21A:
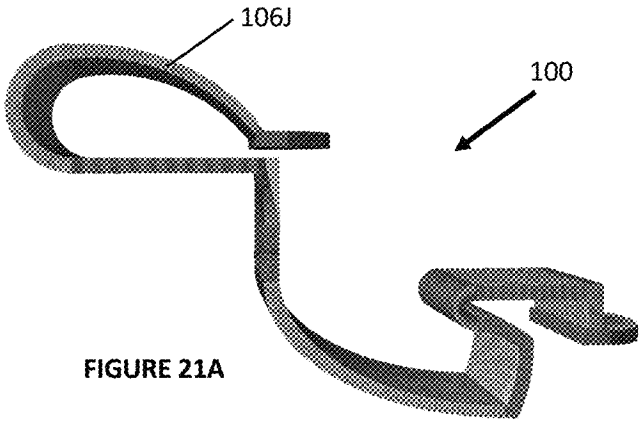
FIG. 21A is a first angle view of a 3D model presenting a further additional clasp tool end variation.

Referring now generally to the Figures and particularly to FIGS. 21A, 21B, and 21C, FIGS. 21A, 21B, and 21C present an additional fixed tool end 106 or attachable tool end 702 shape intended for use as a clasp, presented in FIGS. 21A and 21B as a fixed tool end 106J for the first device 100. This clasping device might be used perhaps as a holder for a map or some papers, the edge of a wrapper for a snack, or anything else that is thin and can be held by a clamp, clip, clothespin, or similar. FIGS. 21A and 21B present this same embodiment of the invented device from different angles, and FIG. 21C presents an attachable tool end 702J version of this tool end variation.

Figure 22:
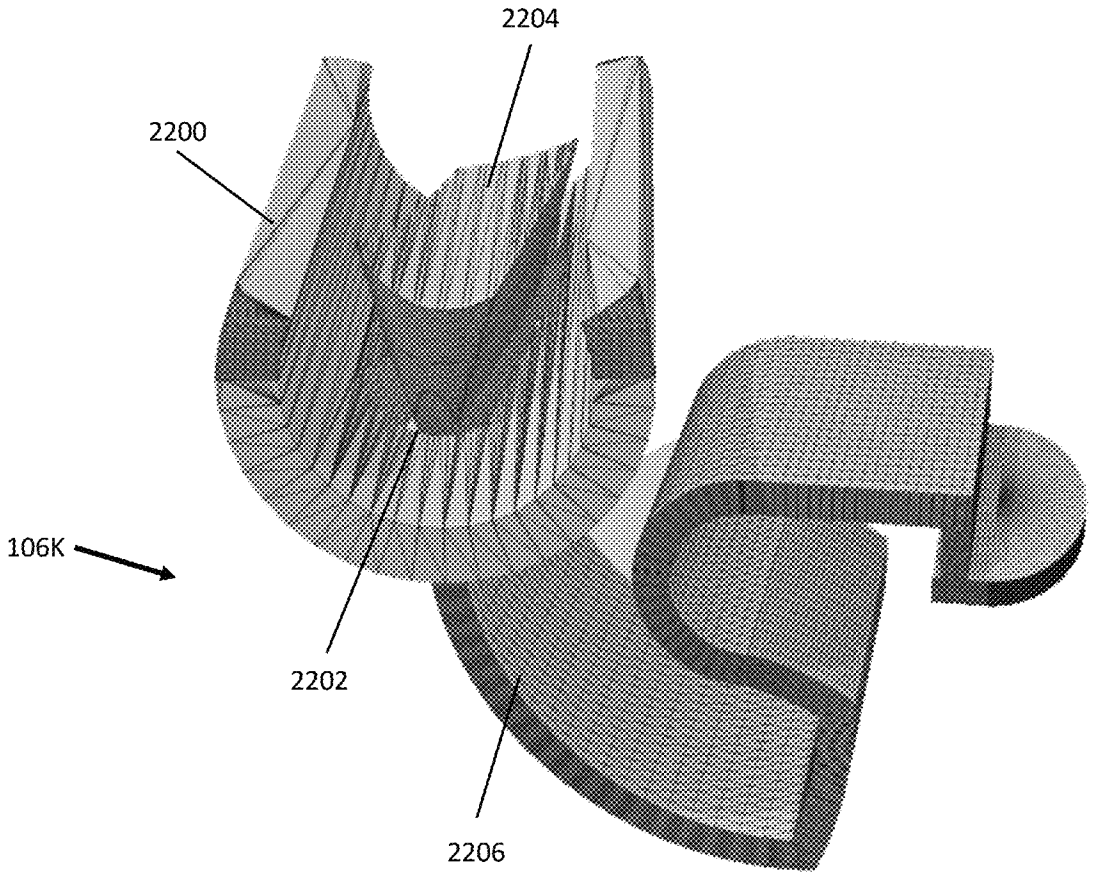
FIG. 22 is a 3D model of a further additional tool end variation in two pieces.
Figure 23B:
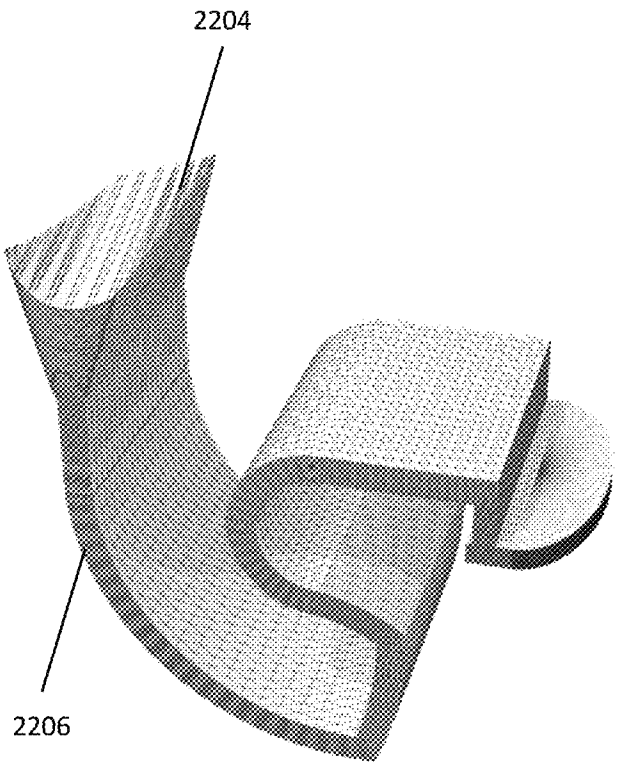
FIG. 23B is a 3D model of the base piece of the variation of FIG. 22.
Figure 23A:
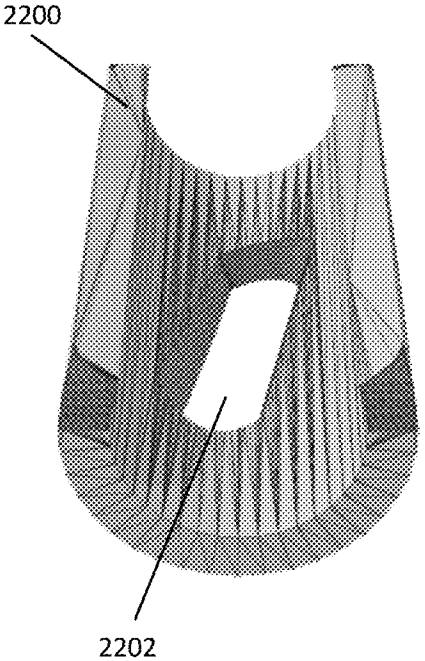
FIG. 23A is a 3D model of the tube piece of the variation of FIG. 22.

Referring now generally to the Figures and particularly to FIG. 22, FIG. 22 is a 3D model image of an additional fixed tool end 106 or attachable tool end 702 shape, a drop down paddle holder 106K, similar to the paddle holder 106A attachment but in two interconnecting pieces, presented separately also in FIGS. 23A and 23B. In the drop down paddle holder 106K embodiment, the tube piece 2200 of the drop down paddle holder 106K includes an aperture 2202 as shown, through which the top 2204 of the drop down paddle holder base 2206 fits through. In certain preferred applications, the design of the drop down paddle holder 106K may make the paddle 300 easier to remove from the holder 106K, or may make the device more user-friendly by allowing the tube to drop down onto the base 2206 when not in use, potentially allowing the device to fold up or retract, or providing fewer angles for a user to accidentally get poked with or break. One notes that this further additional tool end variety might be attached or attachable to any variety of attachment end 104, as previously described herein.

Referring now generally to the Figures and particularly to FIGS. 23A and 23B, FIGS. 23A and 23B are the two pieces of the drop down paddle holder 106K of FIG. 22, presented separately. One notes that, in usual operation, the top 2204 is shaped such that the tube 2200 is inhibited from being simply pulled off the end of the device (and falling right into the water), such as by the aperture 2202 being smaller than the top 2204. Seeing the two pieces of the drop down paddle holder 106K uncoupled this way would be unlikely to occur unless the device were being deliberately dismantled. Ideally, these two pieces might be delivered to an end user already interlocked together as presented in FIG. 22, with the aperture 2202 sized or shaped to fit around the top 2204 but not allow the top 2204 to pass through and separate the pieces entirely.

While selected embodiments have been chosen to illustrate the invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment, it is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

I claim:

1. A device configured for contemporaneous removable coupling with a tool and with a curved lip of a watercraft cockpit wall, the device comprising:

a. An attachment end, a receiver end, and a body length, the body length disposed between the attachment end and the receiver end;

b. The body length adapted to receive an elastic cord extending along the outside of the curved lip;

c. The attachment end shaped to form a friction fit with the curved lip;

d. The receiver end shaped to form a friction fit with the tool; and e. The body length extending the receiver end from the watercraft when the attachment end forms a friction fit with the curved lip.

2. The device of claim 1, wherein the attachment end has a substantially arcuate shape having an inner concave attachment surface that makes contact with and presses against the curved lip.

3. The device of claim 2, wherein the receiver end has a substantially arcuate shape having an inner concave receiver surface that makes contact with and presses against the tool.

4. The device of claim 1, wherein the receiver end has a substantially arcuate shape having an inner concave receiver surface that makes contact with and presses against the curved tool.

5. The device of claim 1, wherein the tool is a paddle having an elongate length and the receiver end is shaped to form a friction fit with the paddle elongate length.

6. The device of claim 2, wherein the tool is a paddle having an elongate length and the receiver end is shaped to form a friction fit with the paddle elongate length.

7. The device of claim 6, wherein the the receiver end has a substantially arcuate shape having an inner concave receiver surface that makes contact with and presses against the paddle elongate length.

8. The device of claim 1, wherein the tool is a container having an elongate cylindrical length and the receiver end is shaped to form a friction fit with the container elongate cylindrical length.

9. The device of claim 2, wherein the tool is a container having an elongate cylindrical length and the receiver end is shaped to form a friction fit with the container elongate cylindrical length.

10. The device of claim 9, wherein the receiver end has a substantially arcuate shape having an inner concave receiver surface that makes contact with and presses against the container elongate cylindrical length.

11. The device of claim 1, wherein the attachment end is sized and shaped to fit curved lips having different dimensions.

12. A device configured for removable coupling with a curved lip of a watercraft cockpit wall, the device comprising:

a. A lip connector and a tool connector;

b. The lip connector comprising an attachment end, a coupling end, and a body length, the body length disposed between the attachment end and the coupling end, and the body length adapted to receive an elastic cord extending along the outside of the curved lip;

c. The attachment end shaped to form a friction fit with the curved lip;

d. The tool connector shaped to form a friction fit with a tool; and e. The lip connector coupling end and the tool connector detachably coupled.

13. The device of claim 12, wherein the attachment end has a substantially arcuate shape having an inner concave attachment surface that makes contact with and presses against the curved lip.

14. The device of claim 12, wherein the tool connector comprises a bottle opener.

15. The device of claim 14, wherein the attachment end has a substantially arcuate shape having an inner concave attachment surface that makes contact with and presses against the curved lip.

16. The device of claim 12, wherein the tool connector comprises a clasping device.

17. The device of claim 16, wherein the attachment end has a substantially arcuate shape having an inner concave attachment surface that makes contact with and presses against the curved lip.

18. The device of claim 1, wherein the lip connector attachment end is sized and shaped to fit curved lips having different dimensions.

19. A device configured for contemporaneous removable coupling with a tool and with a curved lip of a watercraft cockpit wall, the device comprising:

a. An attachment end, an appliance end, and a body length, the body length disposed between the attachment end and the receiver end;

b. The attachment end shaped to form a friction fit with the curved lip;

c. The body length adapted to receive an elastic cord extended along the outside of the curved lip; and d. The appliance end shaped to extend from the watercraft.

20. The device of claim 19, wherein the appliance end comprises a clasping device.

21. The device of claim 19, wherein the appliance end comprises a bottle opener.

22. The device of claim 19, wherein the watercraft is a kayak.

* * * * *